US009819086B2

(12) United States Patent
Ying et al.

(10) Patent No.: US 9,819,086 B2
(45) Date of Patent: Nov. 14, 2017

(54) DUAL-BAND INVERTED-F ANTENNA WITH MULTIPLE WAVE TRAPS FOR WIRELESS ELECTRONIC DEVICES

(71) Applicant: Sony Corporation, Tokyo (JP)

(72) Inventors: Zhinong Ying, Lund (SE); Kun Zhao, Stockholm (SE)

(73) Assignee: Sony Mobile Communications Inc., Tokyo (JP)

( * ) Notice: Subject to any disclaimer, the term of this patent is extended or adjusted under 35 U.S.C. 154(b) by 334 days.

(21) Appl. No.: 14/595,267

(22) Filed: Jan. 13, 2015

(65) Prior Publication Data

US 2016/0204512 A1 Jul. 14, 2016

(51) Int. Cl.

| | |
|---|---|
| ***H01Q 9/04*** | (2006.01) |
| ***H01Q 1/38*** | (2006.01) |
| ***H01Q 5/30*** | (2015.01) |
| ***H01Q 5/314*** | (2015.01) |
| ***H01Q 5/328*** | (2015.01) |
| ***H01Q 21/28*** | (2006.01) |
| ***H01Q 5/321*** | (2015.01) |

(Continued)

(52) U.S. Cl.

CPC ..... *H01Q 9/04* (2013.01); *H01Q 1/243* (2013.01); *H01Q 1/38* (2013.01); *H01Q 1/48* (2013.01); *H01Q 5/314* (2015.01); *H01Q 5/321* (2015.01); *H01Q 5/328* (2015.01); *H01Q 5/371* (2015.01); *H01Q 5/378* (2015.01); *H01Q 9/42* (2013.01); *H01Q 21/28* (2013.01)

(58) Field of Classification Search

CPC ..... H01Q 5/30; H01Q 5/314; H01Q 5/321; H01Q 5/328; H01Q 5/335; H01Q 5/357; H01Q 5/371; H01Q 5/378

USPC ..... 343/893

See application file for complete search history.

(56) References Cited

U.S. PATENT DOCUMENTS

| | | | | |
|---|---|---|---|---|
| 9,577,336 | B2 * | 2/2017 | Ying | H01Q 9/045 |
| 2002/0175873 | A1 * | 11/2002 | King | H01Q 9/32 343/749 |

(Continued)

OTHER PUBLICATIONS

Md Rashidul Islam et al., "Ground Current Modification of Mobile Terminal Antennas and Its Effects," IEEE Antennas and Wireless Propogation Letters, vol. 10, May 2, 2011, pp. 438-441.

(Continued)

*Primary Examiner* — Dameon E Levi
*Assistant Examiner* — Jennifer F Hu
(74) *Attorney, Agent, or Firm* — Myers Bigel P.A.

(57) ABSTRACT

A wireless electronic device includes an inverted-F antenna (IFA) having an IFA exciting element, an IFA feed, and a grounding pin. The IFA exciting element is configured to resonate at two different resonant frequencies, when excited by a signal received through the IFA feed. The wireless electronic device includes a highband wave trap having a length defined based on a first resonant frequency of the IFA exciting element. The highband wave trap is electrically coupled to the IFA exciting element through the grounding pin. A ground patch is electrically coupled between the highband wave trap and the ground plane. The wireless electronic device includes a lowband wave trap having a length defined based on a second resonant frequency of the IFA exciting element. The lowband wave trap is electrically coupled to the ground plane through the ground patch.

19 Claims, 18 Drawing Sheets

(51) Int. Cl.

| | |
|---|---|
| ***H01Q 1/24*** | (2006.01) |
| ***H01Q 1/48*** | (2006.01) |
| ***H01Q 9/42*** | (2006.01) |
| ***H01Q 5/371*** | (2015.01) |
| ***H01Q 5/378*** | (2015.01) |

(56) References Cited

U.S. PATENT DOCUMENTS

2005/0146466 A1* 7/2005 Chung ..... H01Q 1/242 343/700 MS
2005/0156787 A1* 7/2005 Myoung ..... H01Q 1/38 343/700 MS
2007/0030198 A1 2/2007 Wei
2010/0123631 A1* 5/2010 Chang ..... H01Q 1/243 343/700 MS
2011/0122039 A1* 5/2011 Baba ..... H01Q 1/246 343/816
2011/0169703 A1* 7/2011 Schlub ..... H01Q 1/243 343/702
2011/0205138 A1* 8/2011 Yanagi ..... H01Q 9/42 343/845
2012/0013510 A1 1/2012 Yagi
2013/0127677 A1* 5/2013 Lin ..... H01Q 5/328 343/722
2014/0266964 A1* 9/2014 Kato ..... H01Q 5/335 343/860

OTHER PUBLICATIONS

International Search Report and Written Opinion Corresponding to International Application No. PCT/JP2015/003538; dated Oct. 6, 2015; 12 Pages.
Notification concerning transmittal of International Preliminary Report on Patentability, corresponding to application No. PCT/JP2015/003538, dated Jul. 27, 2017.

* cited by examiner

DUAL-BAND INVERTED-F ANTENNA WITH MULTIPLE WAVE TRAPS FOR WIRELESS ELECTRONIC DEVICES

TECHNICAL FIELD

The present inventive concepts generally relate to the field of wireless communications and, more specifically, to antennas for wireless communication devices.

BACKGROUND

Wireless communication devices such as cell phones and other user equipment may include antennas that may be used to communicate with external devices. These antennas may produce different types of radiation patterns in the proximity of the communication device. Some antenna designs, however, may facilitate undesirable amounts of ground currents and irregular radiation patterns.

SUMMARY

Various embodiments of the present inventive concepts include a wireless electronic device including an inverted-F antenna (IFA). The IFA may include an IFA exciting element, an IFA feed, and a grounding pin. The IFA exciting element may be configured to resonate at both a first resonant frequency and a second resonant frequency, different from the first resonant frequency, when excited by a signal received through the IFA feed. The wireless electronic device may include a highband wave trap having a length defined based on the first resonant frequency of the IFA exciting element. The highband wave trap may be electrically coupled to the IFA exciting element through the grounding pin. A ground patch may be electrically coupled between the highband wave trap and a ground plane. The wireless electronic device may include a lowband wave trap having a length defined based on the second resonant frequency of the IFA exciting element, wherein the lowband wave trap is electrically coupled to the ground plane through the ground patch.

According to various embodiments, the length of the highband wave trap may correspond to approximately 0.5 wavelengths of the first resonant frequency of the IFA exciting element. The length of the lowband wave trap may correspond to approximately 0.5 wavelengths of the second resonant frequency of the IFA exciting element. The IFA feed may be located near the center of the highband wave trap, at approximately 0.25 wavelengths of the first resonant frequency of the IFA. The ground patch may be electrically connected to the highband wave trap near the center of the highband wave trap. In various embodiments, the width of the IFA feed on a printed circuit board (PCB) layer may be selected based on the thickness of the PCB layer such that the IFA is impedance matched to the IFA exciting element.

In some embodiments, the IFA may be configured to induce current on the highband wave trap and/or current on the lowband wave trap such that a radiation pattern of the wireless electronic device forms a dipole antenna pattern. The length of the ground patch may be between 0.1 and 0.2 wavelengths. The length of the ground patch may be between 0.1 and 0.2 wavelengths of the first resonant frequency or between 0.1 and 0.2 wavelengths of the second resonant frequency. The length of the ground patch may determine a bandwidth of the highband wave trap. The grounding pin may be electrically conductive and may be impedance matched to the IFA exciting element.

In some embodiments, the IFA feed may include a coplanar waveguide that is electrically connected to the ground plane. The coplanar waveguide may include a conductor track, a first return track on a first side of the conductor track, and a second return track on a second side of the conductor track, opposite the first return track. The first and second return tracks may be electrically isolated from the conductor track.

In some embodiments, the IFA may include a first IFA. One or more additional IFAs, each including an additional IFA feed and an additional IFA exciting element that is configured to resonate at both the first resonant frequency and the second resonant frequency when excited by the signal received through the additional IFA feed. The additional IFAs may each include an additional grounding pin, an additional highband wave trap that is electrically coupled to the additional IFA through the additional grounding pin may. An additional lowband wave trap that is electrically coupled to the ground plane through the additional ground patch be included in each additional IFA of the wireless electronic device. The first IFA and the one or more additional IFAs may extend along an edge of the wireless electronic device.

According to various embodiments, spacing between adjacent ones of the highband wave traps may be between 0.25 wavelengths and 0.5 wavelengths of the first resonant frequency. The spacing between adjacent ones of the lowband wave traps may be between 0.25 wavelengths and 0.5 wavelengths of the second resonant frequency.

In various embodiments, the one or more additional IFAs may include three additional IFAs. The first IFA and the three additional IFA may be configured to receive and/or transmit multiple-input and multiple-output (MIMO) communication.

In various embodiments, the wireless electronic device may include one or more highband IFAs. Each of the highband IFA may include a highband IFA feed, a highband IFA exciting element that is configured to resonate at either the first resonant frequency or the second resonant frequency when excited by the signal received through the highband IFA feed, a highband grounding pin, a highband ground patch, and a dedicated highband wave trap that is electrically coupled to the highband IFA exciting element through the highband grounding pin and that is electrically coupled to the ground plane through the highband ground patch. The one or more highband IFAs may extend along an edge of the wireless electronic device. The first IFA and one of the additional IFAs may be positioned in an alternating pattern with at least one of the highband IFAs along the edge of the wireless electronic device.

Various embodiments of the present inventive concepts include a wireless electronic device including a plurality of dual-band inverted-F antennas (IFAs), each including an IFA feed, an IFA exciting element, a grounding pin, and a ground patch. The IFA exciting element may be configured to resonate at both a first resonant frequency and a second resonant frequency when excited by a signal received through the IFA feed. The wireless electronic device may include a plurality of highband wave traps that are each electrically coupled to a respective one of the plurality of dual-band IFAs through a respective grounding patch. The wireless electronic device may include a plurality of lowband wave traps that are each electrically coupled to a respective one of the plurality of dual-band IFAs through the respective ground patch. The length of one of the plurality of highband wave traps may be based on the first resonant frequency of the respective IFA exciting element. The length of one of the plurality of lowband wave traps may be based on the second resonant frequency of the respective IFA exciting element. The plurality of dual-band IFAs may extend along an edge of the wireless electronic device.

The wireless electronic device including a plurality of dual-band IFA may further include a plurality of highband IFAs, each having a highband IFA feed, a highband IFA exciting element that is configured to resonate at either the first resonant frequency or the second resonant frequency when excited by the signal received through the highband IFA feed, a highband grounding pin, a highband ground patch, and a dedicated highband wave trap. The dedicated highband wave trap may be electrically coupled to the highband IFA exciting element through the highband grounding pin. The dedicated highband wave trap may be electrically coupled to the ground plane through the highband ground patch. The one or more highband IFAs may extend along an edge of the wireless electronic device. Ones of the plurality of dual-band IFAs may be positioned in an alternating pattern with ones of the plurality of the highband IFAs along the edge of the wireless electronic device such that a given highband IFA may be between adjacent ones of the plurality of dual-band IFAs.

Various embodiments of the present inventive concepts include a wireless electronic device including a ground plane, a ground patch that protrudes from an end of the ground plane, a highband wave trap that extends from an end of the ground patch that is remote from the ground plane and extends approximately parallel to the end of the ground plane. A lowband wave trap may extend across and beyond the ground patch and extend approximately parallel to the end of the ground plane and extend approximately parallel to the highband wave trap. A grounding pin may extend from the highband wave trap. The wireless electronic device may include an IFA exciting element that extends from an end of the grounding pin remote from the highband wave trap and extends approximately parallel to the highband wave trap. The wireless electronic device may include an IFA feed extending from the IFA exciting element to the highband wave trap.

Other devices and/or operations according to embodiments of the inventive concept will be or become apparent to one with skill in the art upon review of the following drawings and detailed description. It is intended that all such additional devices and/or operations be included within this description, be within the scope of the present inventive concept, and be protected by the accompanying claims. Moreover, it is intended that all embodiments disclosed herein can be implemented separately or combined in any way and/or combination.

DETAILED DESCRIPTION

Figure 1:
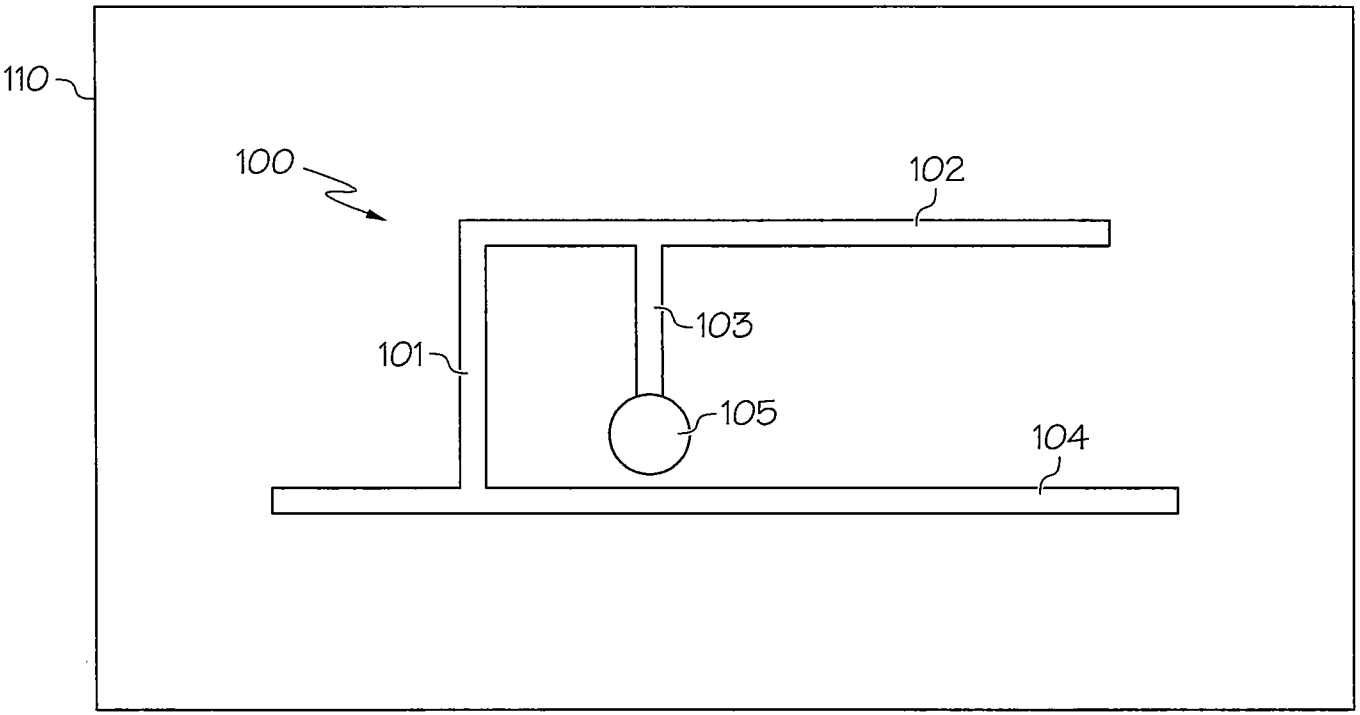
FIG. 1 illustrates an inverted-F antenna (IFA) of a wireless electronic device, according to various embodiments of the present inventive concepts.

The present inventive concepts now will be described more fully with reference to the accompanying drawings, in which embodiments of the inventive concepts are shown. However, the present application should not be construed as limited to the embodiments set forth herein. Rather, these embodiments are provided so that this disclosure will be thorough and complete, and to fully convey the scope of the embodiments to those skilled in the art. Like reference numbers refer to like elements throughout.

The terminology used herein is for the purpose of describing particular embodiments only and is not intended to be limiting of the embodiments. As used herein, the singular forms "a," "an," and "the" are intended to include the plural forms as well, unless the context clearly indicates otherwise. It will be further understood that the terms "comprises," "comprising," "includes," and/or "including," when used herein, specify the presence of stated features, steps, operations, elements, and/or components, but do not preclude the presence or addition of one or more other features, steps, operations, elements, components, and/or groups thereof.

It will be understood that when an element is referred to as being "coupled," "connected," or "responsive" to another element, it can be directly coupled, connected, or responsive to the other element, or intervening elements may also be present. In contrast, when an element is referred to as being "directly coupled," "directly connected," or "directly responsive" to another element, there are no intervening elements present. As used herein, the term "and/or" includes any and all combinations of one or more of the associated listed items.

Spatially relative terms, such as "above," "below," "upper," "lower," "top," "bottom," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms "first," "second," etc. may be used herein to describe various elements, these elements should not be limited by these terms. These terms are only used to distinguish one element from another. Thus, a first element could be termed a second element without departing from the teachings of the present embodiments.

Unless otherwise defined, all terms (including technical and scientific terms) used herein have the same meaning as commonly understood by one of ordinary skill in the art to which these embodiments belong. It will be further understood that terms, such as those defined in commonly-used dictionaries, should be interpreted as having a meaning that is consistent with their meaning in the context of the relevant art and will not be interpreted in an idealized or overly-formal sense unless expressly so defined herein.

An inverted-F antenna (IFA) is commonly used in microwave antenna designs for wireless electronic devices such as mobile terminals. IFA designs may be compact in size and easy to manufacture since they may be implemented as edge printed features on printed circuit boards (PCBs). Various wireless communication applications may use an array of IFAs. A disadvantage of IFA designs may be the that there may be a single resonant frequency with poor frequency response around the single resonant frequency. This may cause higher radiation coupling between antenna array elements and may induce irregular radiation patterns. Higher coupling between antenna array elements and irregular radiation patterns may not be suitable for extremely high frequency (EHF) radio antenna applications such as millimeter wave antenna arrays for use in the 10 to 300 GHz frequency range. These millimeter wave frequencies may be used for various types of communication in smart phones such as broadband internet access, Wi-Fi, etc. Moreover, array antennas may narrow the radiation pattern into a beam that is directional and may require the device to be directed towards the base station.

The inverted-F antenna design may be improved by adding a highband wave trap and/or a lowband wave trap that are impedance matched to the IFA exciting element of the IFA. The highband and/or lowband wave traps may improve the frequency response around selected highband and/or lowband frequencies. Additionally, the highband and/or lowband wave traps may prevent, stop, and/or reduce ground currents in the ground plane. The radiation patterns may thus be improved by adding highband and/or lowband wave traps to the IFA by reducing lobes and distortion. The IFA with a highband and/or lowband wave trap may exhibit good polarization characteristics with a broad radiation beam that is substantially symmetric with wide scanning angles.

Referring now to FIG. 1, the diagram illustrates an inverted-F antenna (IFA) 100 of a wireless electronic device 110. The IFA 100 includes an IFA exciting element 102, an IFA feed 103, a ground plane 104, and a grounding pin 101. The end of the IFA feed 103 may include a test point 105. The IFA feed 103 may be a stripline. The stripline may include an electrically conductive material. In some embodiments, the stripline may include a matching network including one or more inductors, capacitors, and/or resistors. A signal received at the IFA feed 103 and/or a signal injected at the test point 105 may excite the IFA exciting element 102.

Figure 2:
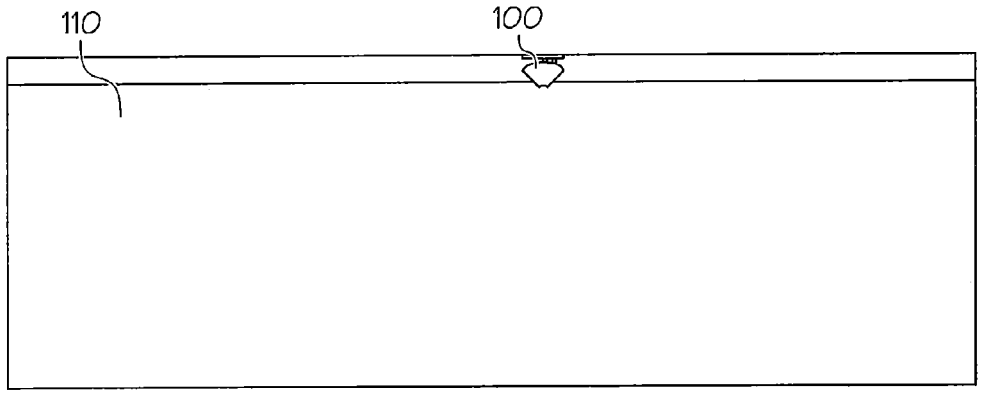
FIG. 2 illustrates a wireless electronic device including the IFA of FIG. 1, according to various embodiments of the present inventive concepts.
Figure 3:
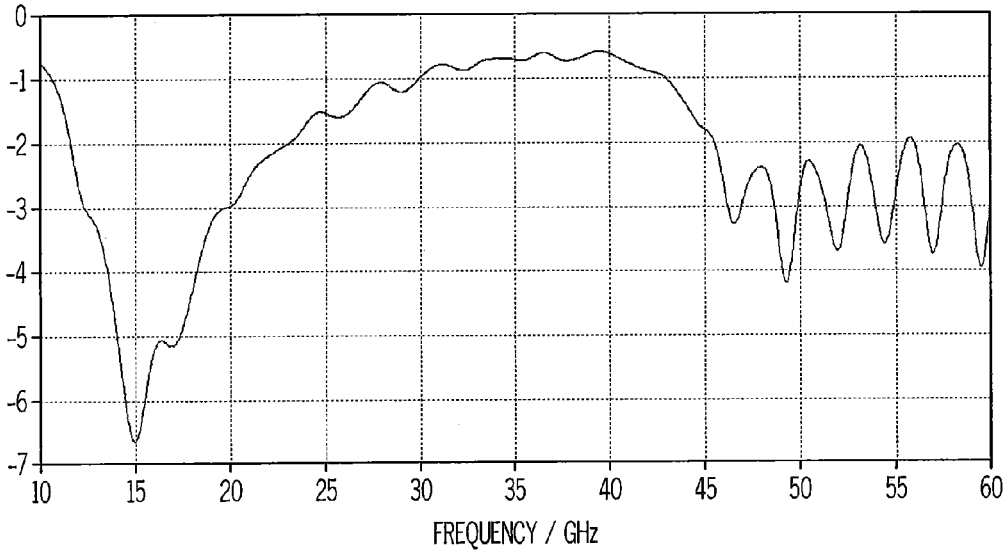
FIG. 3 graphically illustrates the frequency response of the antenna of FIGS. 1 and 2, according to various embodiments of the present inventive concepts.

Referring now to FIG. 2, a wireless electronic device 110 is illustrated that includes an antenna 100. The inverted-F antenna 100 is positioned along an edge of the wireless electronic device. Referring now to FIG. 3, the frequency response of the antenna 100 of FIGS. 1 and 2 is graphically illustrated. In this non-limiting example, the frequency response illustrates a single lowband resonant frequency of approximately 15 GHz. The bandwidth around this lowband resonant frequency appears to be narrow. In other words, the frequency response around the lowband resonant frequency may produce a small bandwidth response around the lowband resonant frequency.

Figure 4:
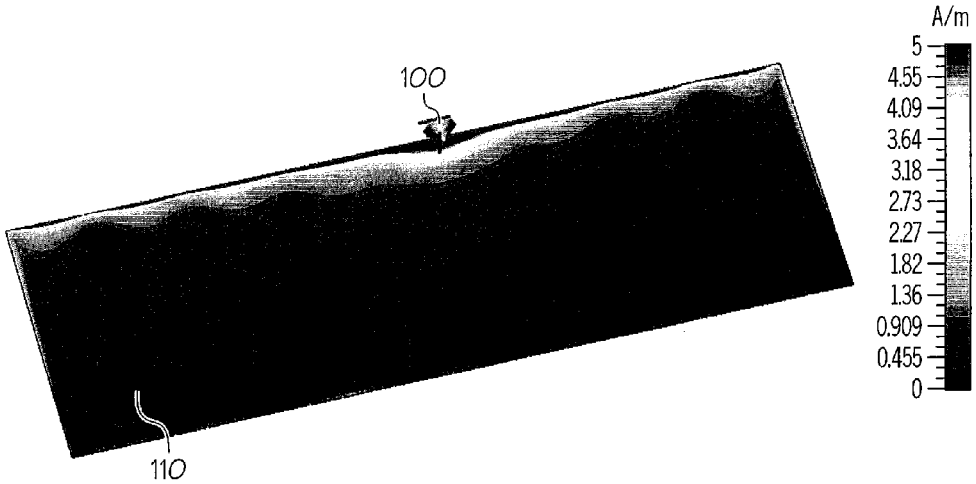
FIG. 4 illustrates surface waves at 15 GHz excitation along the wireless electronic device of FIG. 2, according to various embodiments of the present inventive concepts.

Referring now to FIG. 4, surface waves at 15 GHz excitation along the wireless electronic device 110 are illustrated. Irregular surface waves that expand across much of the wireless electronic device 110 are shown. These irregular surface waves may produce poor frequency response at the lowband resonant frequency.

Figure 5:
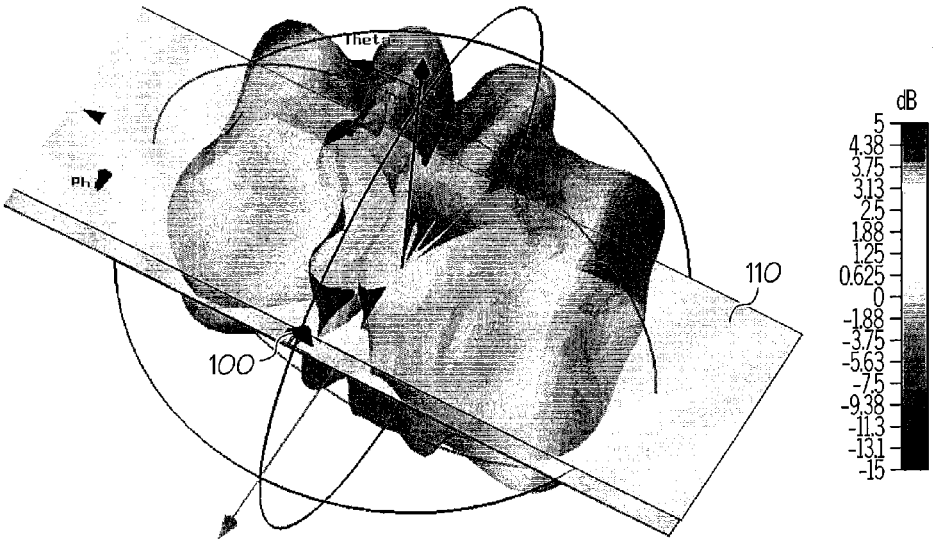
FIG. 5 illustrates the radiation pattern around a wireless electronic device such as a smartphone, including the inverted-F antenna of FIG. 1, according to various embodiments of the present inventive concepts.

Referring now to FIG. 5, the radiation pattern around a wireless electronic device 110 including the inverted-F antenna of FIG. 1 is illustrated. When the antenna 100 is excited at 15 GHz, an irregular radiation pattern is formed around the wireless electronic device 110. The radiation pattern around the wireless electronic device 110 includes irregular lobes and distortion that may not be suitable for communication at this frequency.

The radiation pattern formed by an array of inverted-F antennas of FIG. 1 may be acceptable at lower frequencies such as, for example, in the cellular band of 850 to 1900 MHz. However, distortion with many irregular lobes may occur at millimeter band radio frequencies in the electromagnetic spectrum from 10 to 300 GHz, as illustrated in FIG. 5.

Figure 6:
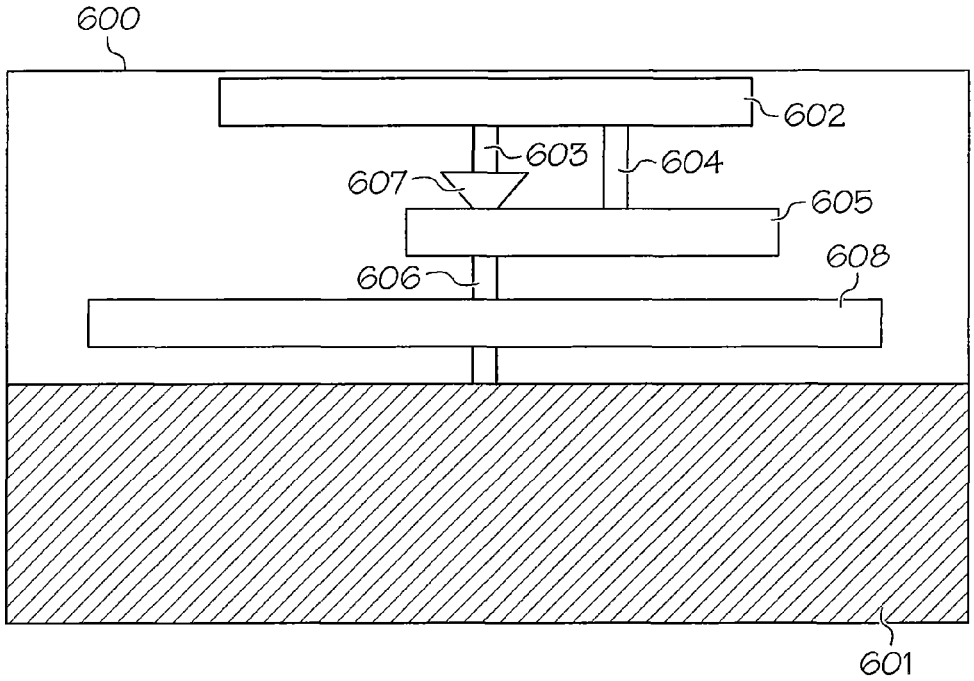
FIG. 6 illustrates an antenna including a highband wave trap and a lowband wave trap, according to various embodiments of the present inventive concepts.

Referring now to FIG. 6, an inverted-F antenna (IFA) 600 including a highband wave trap 605 and/or a lowband wave trap 608, according to various embodiments of the inventive concepts is illustrated. This antenna 600 may be a dual-band antenna with at least two different resonant frequencies. An IFA exciting element 602 may be excited by a signal received through an IFA feed 603. The IFA 600 may have a highband resonant frequency and/or a lowband resonant frequency. The IFA feed 603 may be connected at one end to a test point 607. According to some embodiments, the test point 607 and/or the IFA feed 603 may be electrically connected to highband wave trap 605. Signals may be introduced at the test point 607 to excite the IFA exciting element 602. The IFA feed 603 may be coupled to a transceiver for sending and receiving communication signals. The IFA exciting element 602 may be electrically connected by a grounding pin 604 to the highband wave trap 605. The grounding pin 604 may be electrically conductive and may be sized to impedance match the IFA exciting element. Impedance matching may be desirable for reducing mismatch losses to minimize reflections of signals, thereby reducing distortion in the radiation pattern of antenna 600. The grounding pin 604 may be embodied by a path coupling element, stub, or via between different layers of a printed circuit board.

Still referring to FIG. 6, in some embodiments, the highband wave trap 605 may be approximately parallel to the IFA exciting element 602. The lowband wave trap 608 may be approximately parallel to the IFA exciting element 602. The highband wave trap 605 may be electrically connected to the ground plane 601 by a ground patch 606. The terms "ground pin" and "ground patch" are used to distinguish these elements from one another. However, in some embodiments, they may be embodied by a similar structure. The lowband wave trap 608 may be electrically connected to the ground plane 601 by ground patch 606. The ground patch 606 may be embodied by a path coupling element, stub, via between different layers of a printed circuit board, or as an isolated portion of the ground plane 601. The length of the highband wave trap 605 may correspond to approximately 0.5 wavelengths of the highband resonant frequency of the IFA exciting element 602. The length of the lowband wave trap 608 may correspond to approximately 0.5 wavelengths of the lowband resonant frequency of the IFA exciting element 602. The IFA feed 603 may be located near the center of the highband wave trap 605 and/or near the center of the lowband wave trap 608, at approximately 0.25 wavelengths of the highband resonant frequency and/or lowband resonant frequency of the IFA exciting element 602. In other words, an edge mounted IFA may be built on a balanced 0.25 wavelength highband wave trap and/or on a balanced 0.25 wavelength lowband wave trap. The length of the ground patch 606 may be 0.1 to 0.2 wavelengths of a lowband and/or highband resonant frequency of the IFA exciting element 602. The length of the ground patch 606 may determine the signal bandwidth supported by the highband wave trap 605 and/or the lowband wave trap 608. Reducing the length of the ground patch 606 may reduce the signal bandwidth supported by the highband wave trap 605 and/or the lowband wave trap 608. In some embodiments, the width of the ground patch 606 may be greater than the width of the IFA feed 603.

The highband wave trap 605 and/or the lowband wave trap 608 may prevent, stop, and/or reduce current and/or current loops on the ground plane 601. When excited by a signal at the IFA feed 603, a current may be induced on the highband wave trap 605 and/or on the lowband wave trap 608, forming a dipole mode on the highband wave trap 605 and/or on the lowband wave trap 608. A dipole mode may be a magnetic dipole based on a closed circulation of current. The collective structure including the highband wave trap 605 and/or the lowband wave trap 608 may thus behave as a dipole antenna. More specifically, the antenna 600 may be configured to induce current on the highband wave trap 605 and/or on the lowband wave trap 608 such that a radiation pattern of the wireless electronic device forms a dipole antenna pattern. The highband wave trap 605 may be configured to resonate at a first resonant frequency, whereas the IFA exciting element 602 may be configured to resonate at a second resonant frequency that is different from the first resonant frequency. In some embodiments, the lowband wave trap 608 may be configured to resonate at a third resonant frequency that is different from the first and second resonant frequencies. Coupling of radiation patterns related to the first, second, and/or third resonant frequencies may result in the dipole antenna pattern.

FIG. 6 may also be regarded as illustrating a inverted-F antenna 600 including a ground plane 601, a ground patch 606 that protrudes from an end of the ground plane 601, a highband wave trap 605 that extends from an end of the ground patch 606 that is remote from the ground plane 601 and extends approximately parallel to the end of the ground plane 601. A lowband wave trap 608 may extend across and beyond the ground patch 606 and extend approximately parallel to the end of the ground plane 601 and extend approximately parallel to the highband wave trap 605. A grounding pin 604 may extend from the highband wave trap 605. The antenna 600 may include an IFA exciting element 602 that extends from an end of the grounding pin 604 remote from the highband wave trap 605 and extends approximately parallel to the highband wave trap 605. The antenna 600 may include an IFA feed 603 extending from the IFA exciting element 602 to the highband wave trap 605.

Figure 7:
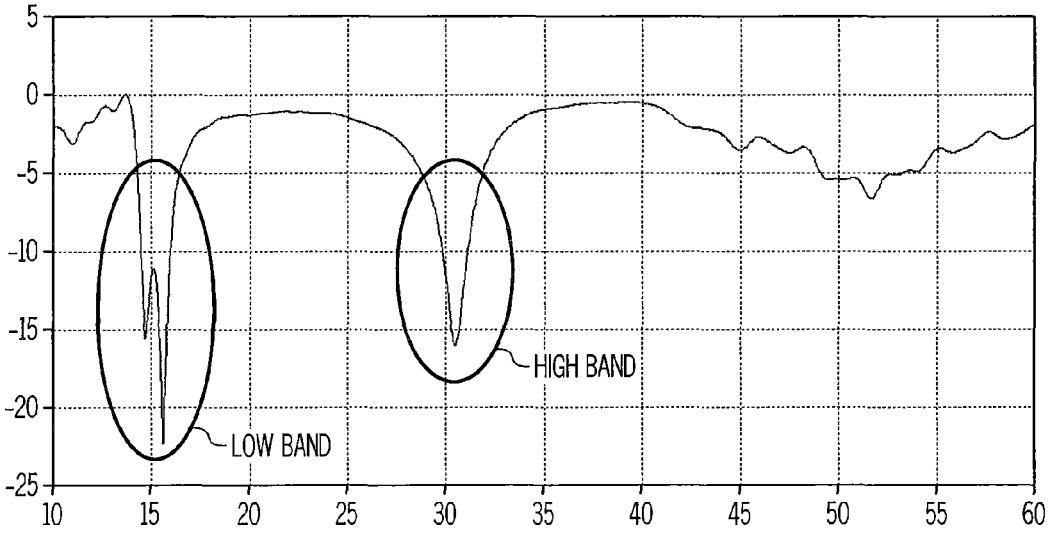
FIG. 7 graphically illustrates the frequency response of the antenna of FIG. 6, according to various embodiments of the present inventive concepts.

Referring now to FIG. 7, the frequency response of the antenna of FIG. 6 is graphically illustrated. In this non-limiting example, the frequency response illustrates a lowband resonant frequency of approximately 15 GHz and a highband resonant frequency of approximately 30 GHz. The −10 dB bandwidth around the lowband resonant frequency may be around 3 GHz, which may be approximately 20% of the lowband resonant frequency. The −10 dB bandwidth around the highband resonant frequency may be around 3 GHz. The very wide bandwidths provided by this antenna around the lowband and/or highband resonant frequencies offer excellent signal integrity with potential for use at several different frequencies in this bandwidth range.

Figure 8:
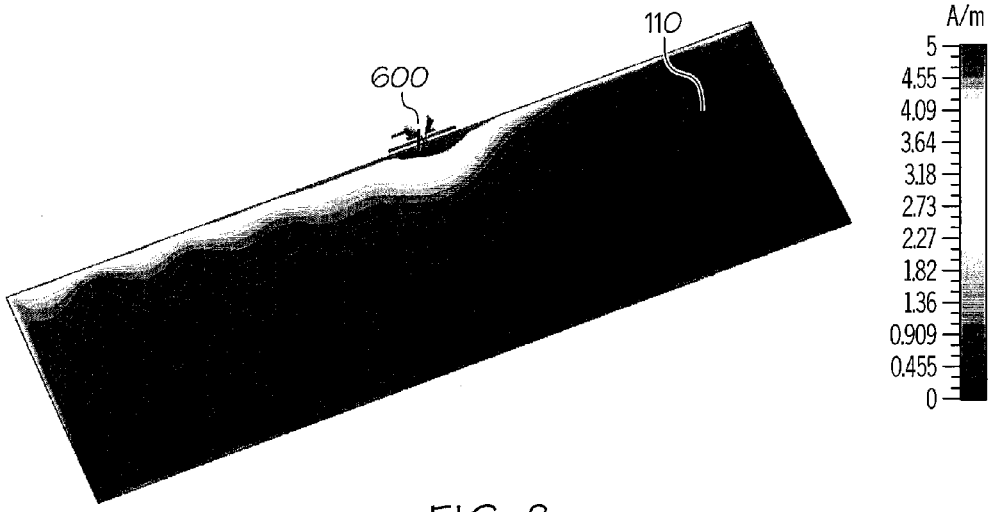
FIG. 8 illustrates surface waves, at 15 GHz excitation, along a wireless electronic device including the antenna of FIG. 6, according to various embodiments of the present inventive concepts.
Figure 10:
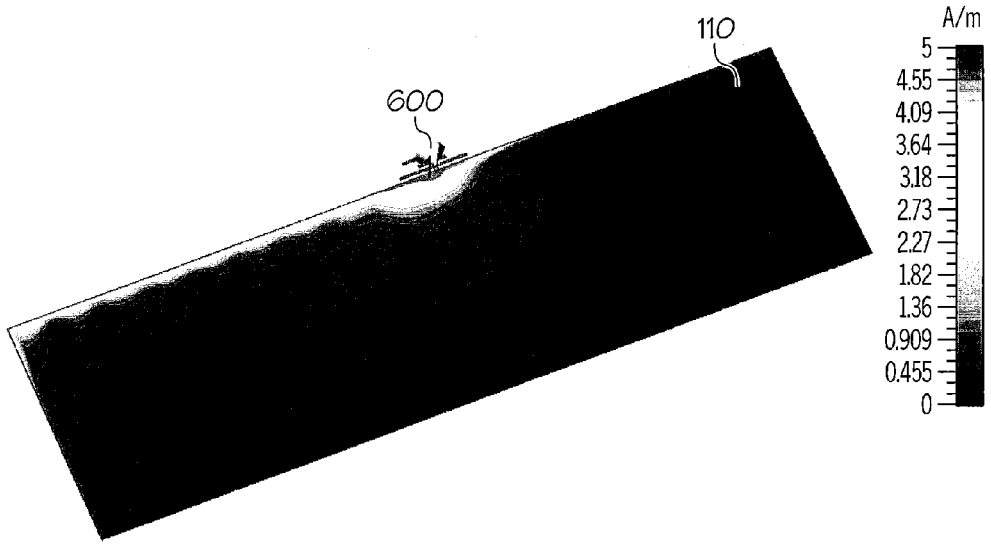
FIG. 10 illustrates surface waves, at 30 GHz excitation, along the wireless electronic device of FIG. 6, according to various embodiments of the present inventive concepts.

Referring now to FIGS. 8 and 10, surface waves at 15 GHz and 30 GHz, respectively, are illustrated along the wireless electronic device 110 including the antenna of FIG. 6 with a highband wave trap and/or a lowband wave trap. When compared to the surface waves for the antenna of FIG. 1 illustrated in FIG. 4, the irregular surface waves that expand across much of the wireless electronic device 110 appear to be reduced in FIGS. 8 and 10. The reduced surface waves may produce improved frequency response at the respective resonant frequencies.

Figure 9:
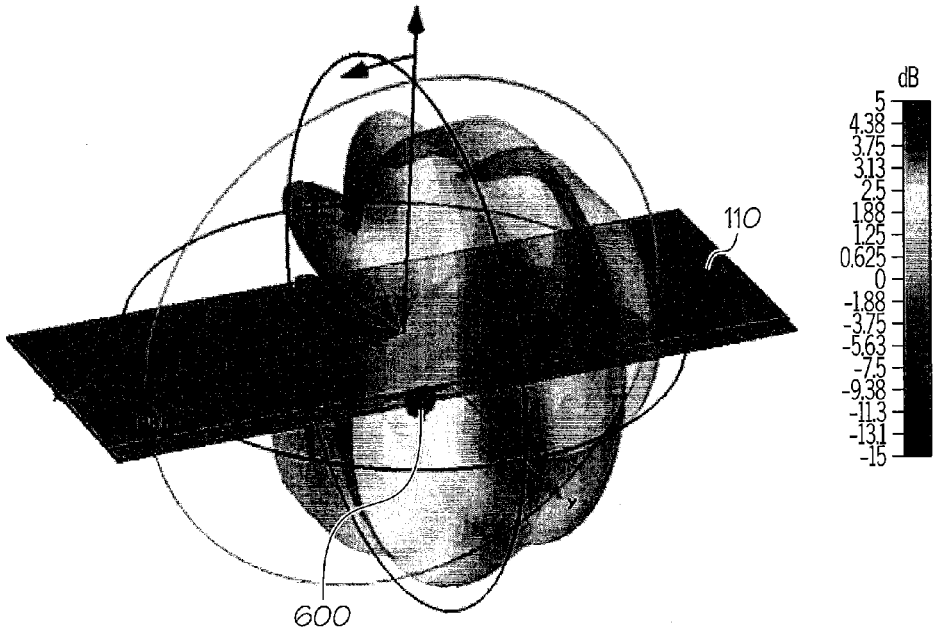
FIG. 9 illustrates the radiation pattern, at 15 GHz excitation, around a wireless electronic device such as a smartphone, including the antenna of FIG. 6, according to various embodiments of the present inventive concepts.
Figure 11:
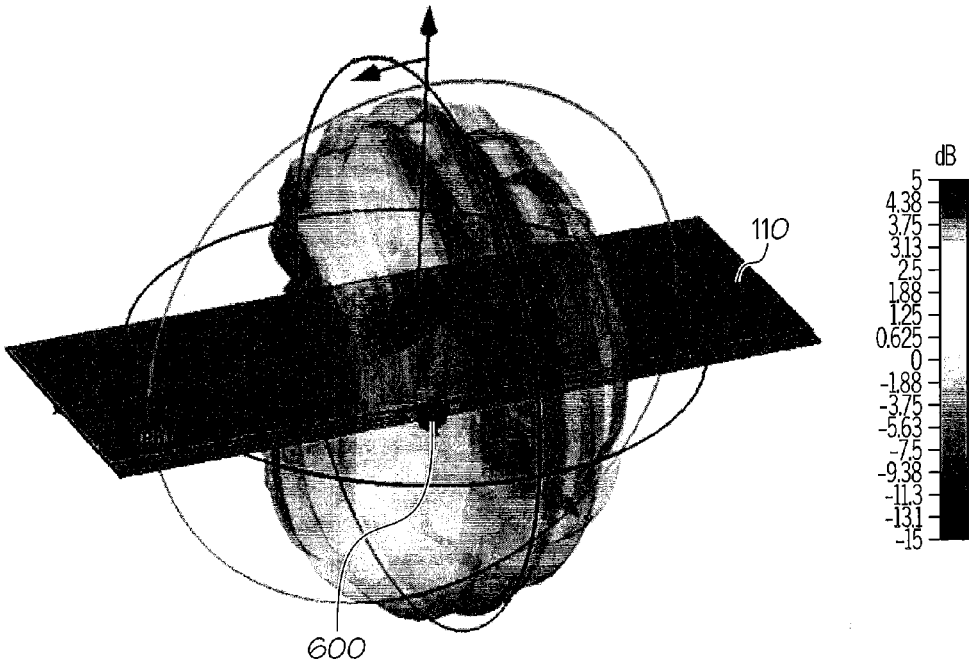
FIG. 11 illustrates the radiation pattern, at 30 GHz excitation, around a wireless electronic device such as a smartphone, including the antenna of FIG. 6, according to various embodiments of the present inventive concepts.

Referring now to FIGS. 9 and 11, radiation patterns at approximately 15 GHz and 30 GHz, respectively, are illustrated for the antenna of FIG. 6. The radiation patterns at approximately 15 GHz and 30 GHz each span more broadly and uniformly around the wireless electronic device 110 with fewer prominent side lobes and less distortion than the radiation pattern of FIG. 5. Accordingly, the antenna design of FIG. 6 described herein may provide better performance at a variety of extremely high frequencies when compared to the antenna of FIG. 1.

Figure 12:
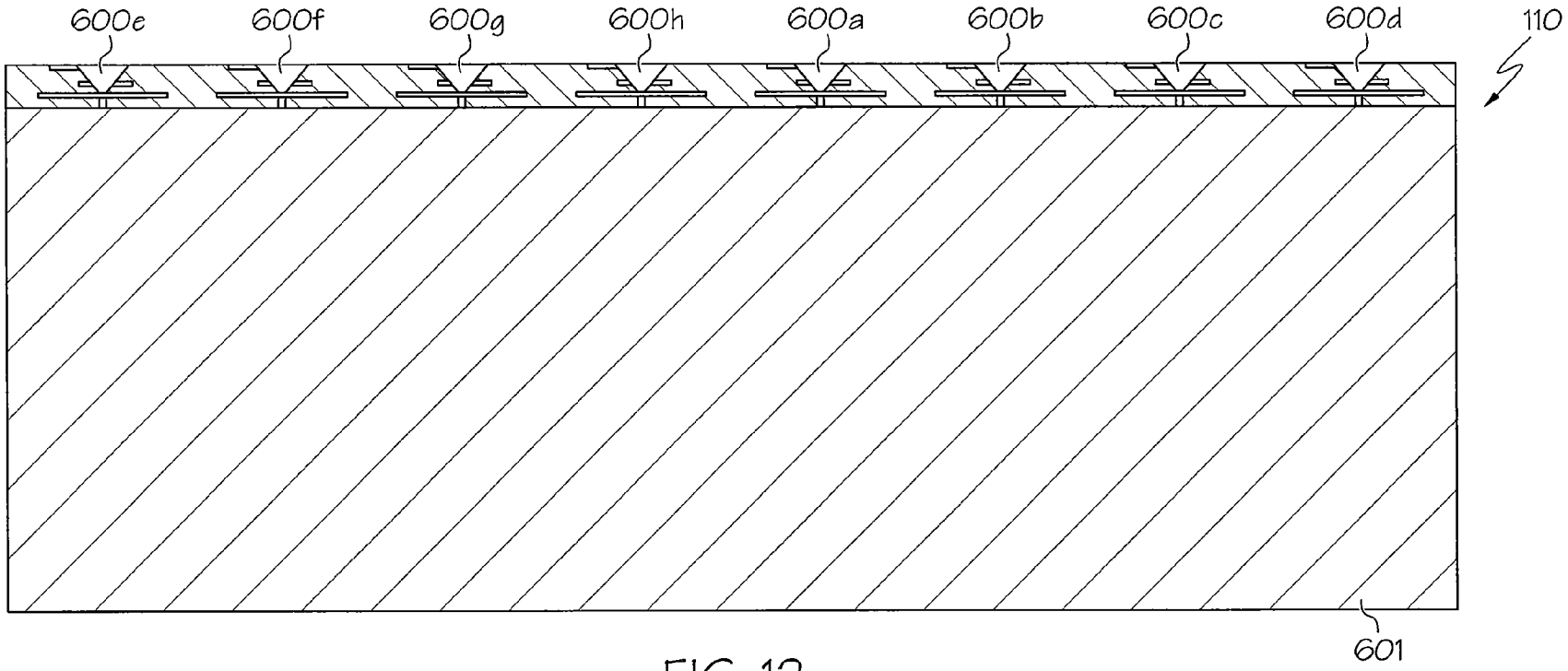
FIG. 12 illustrates a wireless electronic device including an array of antennas of FIG. 6, according to various embodiments of the present inventive concepts.

Referring now to FIG. 12, a wireless electronic device 110 including an array of antennas 600*a*-600*h* of FIG. 6 along the edge of the wireless electronic device 110 is illustrated. Each of the antennas 600*a*-600*h* may include an IFA exciting element 602, a grounding pin 604, a ground patch 606, and a IFA feed 603, a highband wave trap 605 and/or a lowband wave trap 608, as illustrated in FIG. 6. Each of the antennas 600*a*-600*h* may be electrically coupled to the ground plane 601, as illustrated in FIG. 6. In some embodiments, a common ground may be shared between two or more antennas 600*a*-600*h*. Spacing between adjacent highband wave traps and/or lowband wave traps may be between 0.25 and 0.5 wavelengths of the highband and/or lowband resonant frequencies, measured from tip-to-tip of the highband wave traps and/or lowband wave traps. In some embodiments, spacing between adjacent highband wave traps and/or lowband wave traps may be between 0.25 and 0.5 wavelengths center-to-center of the highband wave traps and/or lowband wave traps. In some embodiments, the spacing between adjacent highband wave traps and/or lowband wave traps may be slightly less than 0.5 wavelengths, at for example, 0.45 wavelengths. In some embodiments, the spacing between adjacent highband wave traps and/or lowband wave traps may be based on the demand bandwidth of the wireless electronic device.

Still referring to FIG. 12, in some embodiments, the antennas 600*a*-600*h* may include two arrays of four antennas each. For example, antennas 600*a*-600*d* may be one array while antennas 600*e*-600*h* may be a second array. The first and second arrays may each function independently as a receive antenna and/or a transmit antenna. In some embodiments, the array of antennas 600 may include four antennas 600 and may be configured to receive and/or transmit multiple-input and multiple output (MIMO) communication.

Figure 13:
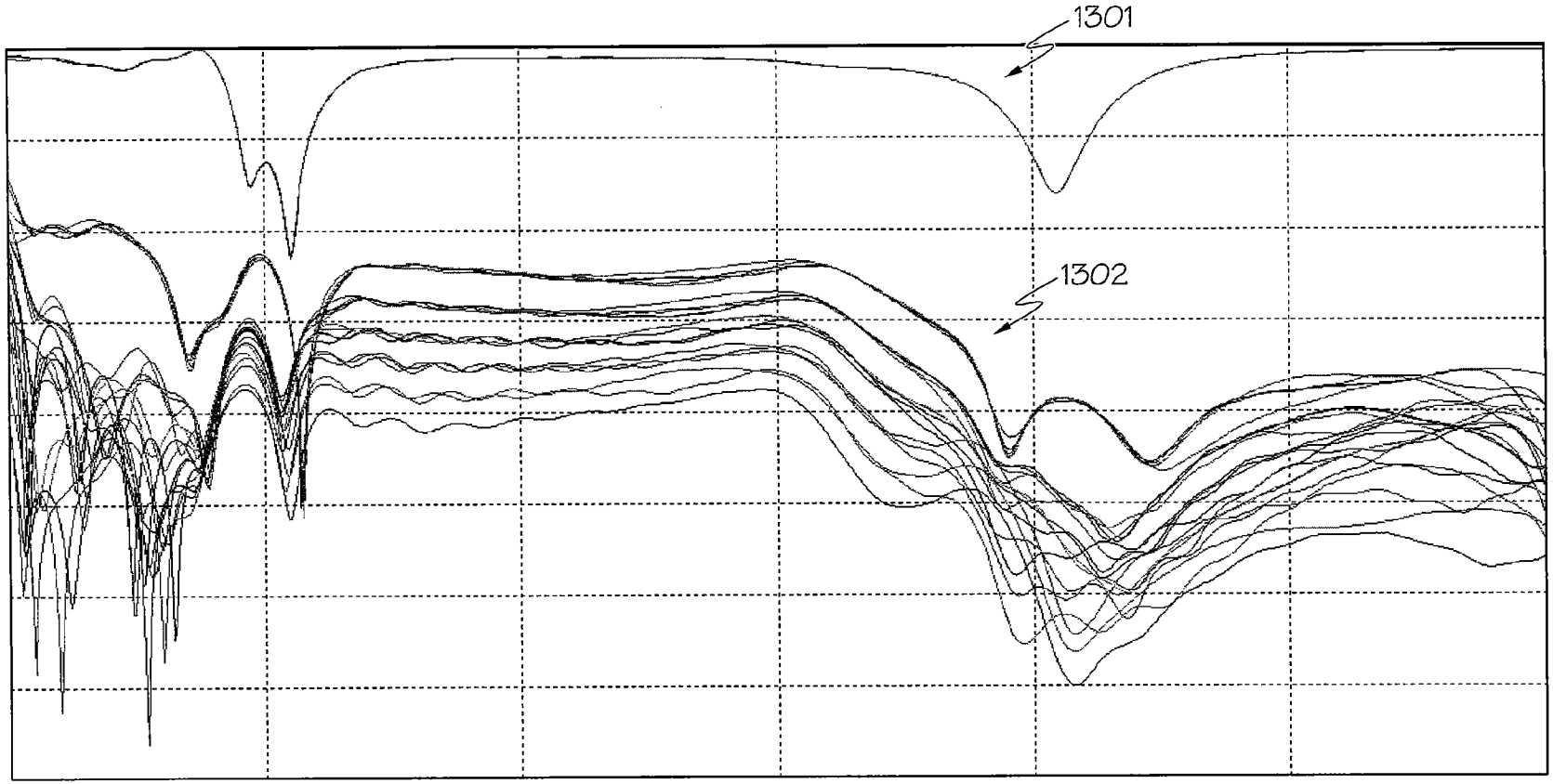
FIG. 13 graphically illustrates the frequency response of the antennas of FIG. 12, according to various embodiments of the present inventive concepts.

Referring now to FIG. 13, the frequency response of the antennas 600*a*-600*h* of FIG. 12 is illustrated. Curve 1301 illustrates the overall frequency response of the wireless electronic device 110 including antennas 600*a*-600*h* of FIG. 12. Each of curves 1302 illustrates the frequency response for an individual antenna of antennas 600*a*-600*h* of FIG. 12, with each curve including the mutual coupling between different antennas 600*a*-600*h*. The antenna structures 600*a*-600*h* of FIG. 12 each include a highband wave trap 605 and/or a lowband wave trap 608, as illustrated in FIG. 6. The antenna structure including the highband wave trap 605 and/or the lowband wave trap 608 provide low mutual coupling between various antenna elements, as illustrated by curves 1302 of FIG. 13.

Figure 14B:
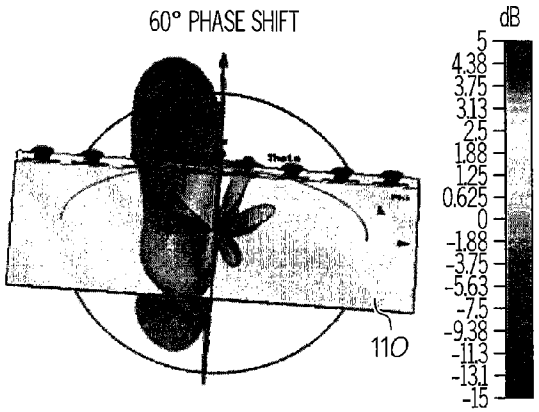
FIGS. 14A-14C illustrate the radiation patterns, at 15 GHz excitation at various phase shifts, around a wireless electronic device such as a smartphone, including the antenna array of FIG. 12, according to various embodiments of the present inventive concepts.
Figure 14C:
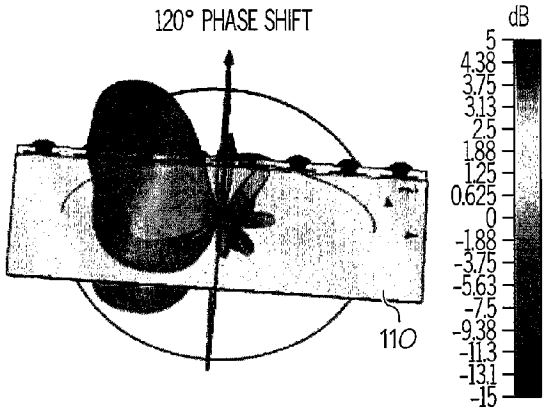
Figure 14A:
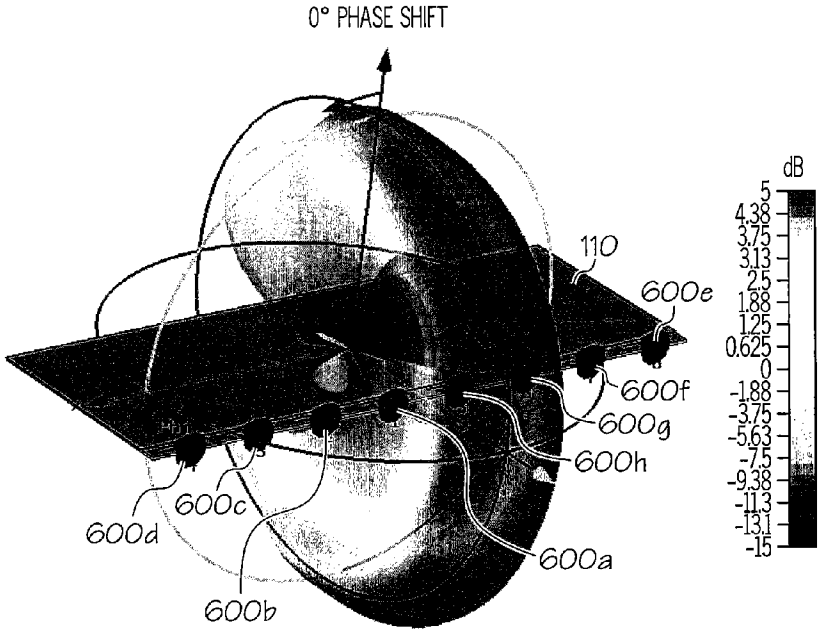

Referring now to FIGS. 14A-14C, radiation patterns at approximately 15 GHz for phase shifts of 0°, 60°, and 120°, respectively, are illustrated for the antenna array of FIG. 12. The different phase shifts may be obtained based on processor post-processing of signals received at one or more of the antennas 600*a*-600*h* in order to control scanning angles to provide an equiphase wave front. The radiation patterns at approximately 15 GHz at phase shifts of 0°, 60°, and 120° each span more broadly and uniformly around the wireless electronic device 110 with fewer prominent side lobes and less distortion at 15 GHz than the radiation pattern of FIGS. 5 and/or 11. In some cases, phase shifts may reduce performance of the antenna. However, as illustrated by FIGS. 14B and 14C, application of a phase shift at 15 GHz to antenna array 600 still appears to produce excellent radiation patterns. Accordingly, the antenna array design of FIG. 12 described herein may provide better performance at 15 GHz for a variety of extremely high frequencies when compared to the antennas of FIGS. 1 and/or 6.

Figure 15B:
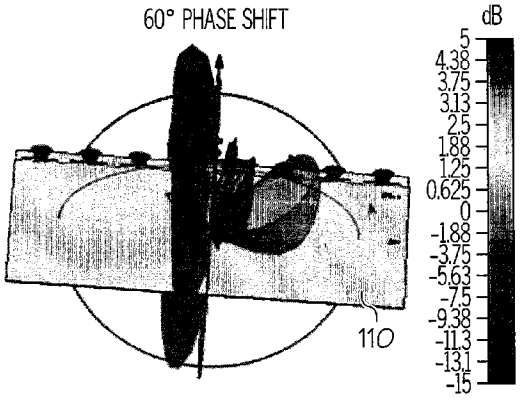
FIGS. 15A-15C illustrate the radiation patterns, at 30 GHz excitation at various phase shifts, around a wireless electronic device such as a smartphone, including the antenna array of FIG. 12, according to various embodiments of the present inventive concepts.
Figure 15C:
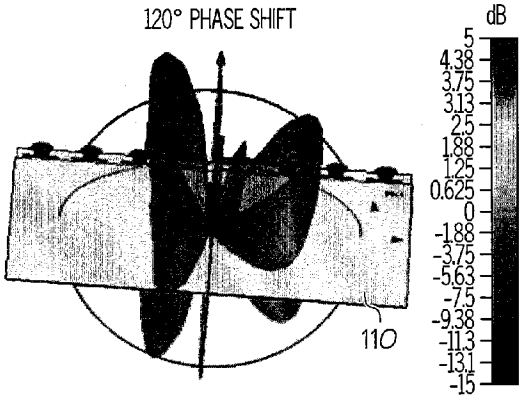
Figure 15A:
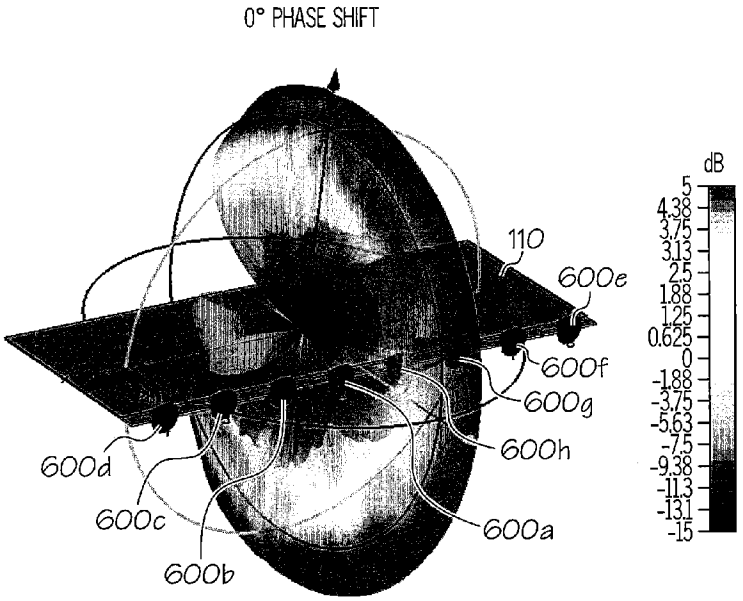

Referring now to FIGS. 15A-15C, radiation patterns at approximately 30 GHz for phase shifts of 0°, 60°, and 120°, respectively, are illustrated for the antenna array of FIG. 12. The different phase shifts may be obtained based on processor post-processing of signals received at one or more of the antennas 600*a*-600*h* in order to control scanning angles to provide an equiphase wave front. The radiation patterns at approximately 30 GHz at phase shifts of 0°, 60°, and 120° each span more broadly and uniformly around the wireless electronic device 110 with fewer prominent side lobes and less distortion than the radiation pattern of FIG. 11. In some cases, phase shifts may reduce performance of the antenna. However, as illustrated by FIGS. 15B and 15C, application of a phase shift at 30 GHz to antenna array 600 still appears to produce excellent radiation patterns. Accordingly, the antenna array design of FIG. 12 described herein may provide better performance at 30 GHz for a variety of extremely high frequencies when compared to the antenna of FIG. 6.

The antenna array 600 of FIG. 12 may be used for dual-band applications. A non-limiting example of a dual-band antenna array 600 with resonant frequencies at 15 GHz and 30 GHz has been discussed. The antenna elements 600*a*-600*h* include two wave traps, including a lowband wave trap for 15 GHz and a highband wave trap for 30 GHz, that suppress and/or reduce surface waves at these frequencies. As illustrated in FIGS. 13-15C, this dual-band antenna array 600 performed well with an array gain >8 dB with 120° phase shifts at both 15 GHz and 30 GHz. However, the spacing between the antenna elements may based on the lowband resonant frequency (for example, 15 GHz), which may induce undesirable side lobes at 30 GHz.

Figure 16:
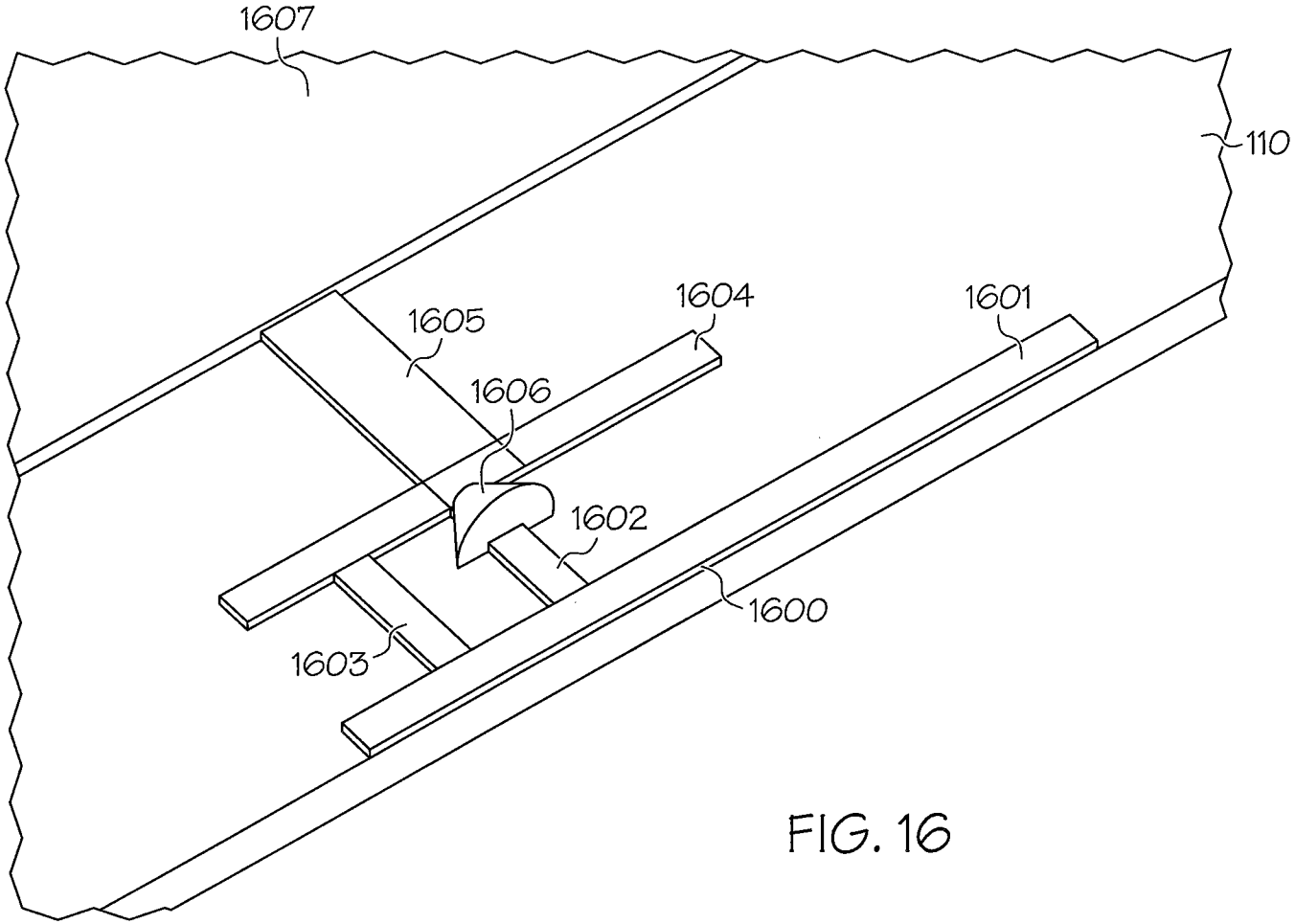
FIG. 16 illustrates an antenna including a highband wave trap for 30 GHz, according to various embodiments of the present inventive concepts.

Referring now to FIG. 16, a wireless electronic device 110 with a highband antenna 1600 including a single highband wave trap 1604 is illustrated. In this non-limiting example, the highband antenna 1600 may resonate at a single highband resonant frequency of approximately 30 GHz. The highband antenna 1600 may include an IFA exciting element 1601 that may be excited by a signal received through the IFA feed 1602. A test point 1606 may be connected to one end of the IFA feed 1602. The IFA exciting element 1601 may be electrically connected by a grounding pin 1603 to a highband wave trap 1604, that is substantially parallel to the IFA exciting element 1601. The highband wave trap 1604 may be electrically connected to a ground plane 1607 through a ground patch 1605.

Figure 17:
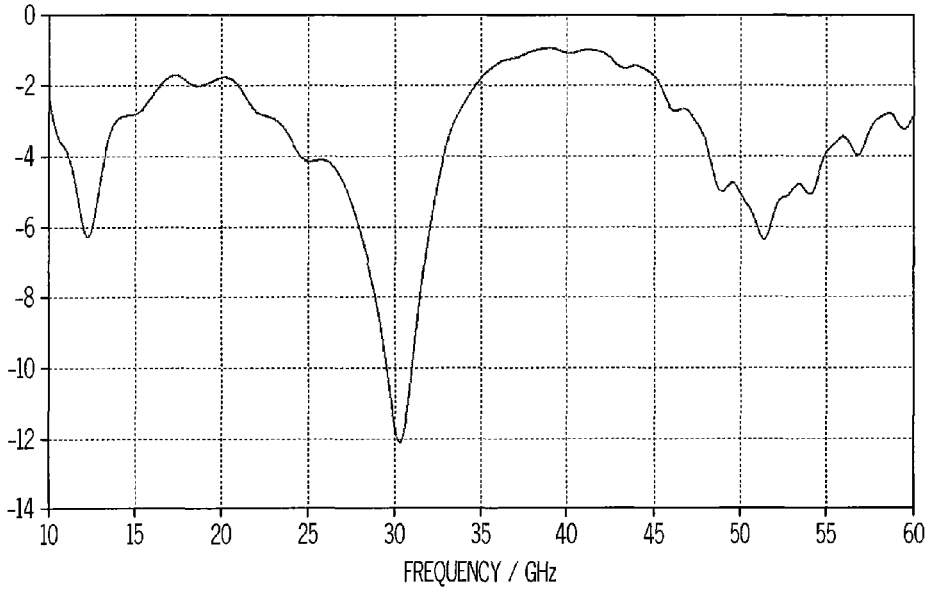
FIG. 17 graphically illustrates the frequency response of the antenna of FIG. 16, according to various embodiments of the present inventive concepts.

Referring now to FIG. 17, the frequency response of the antenna of FIG. 16 is graphically illustrated. In this non-limiting example, the frequency response illustrates a single highband resonant frequency of approximately 30 GHz.

Figure 18:
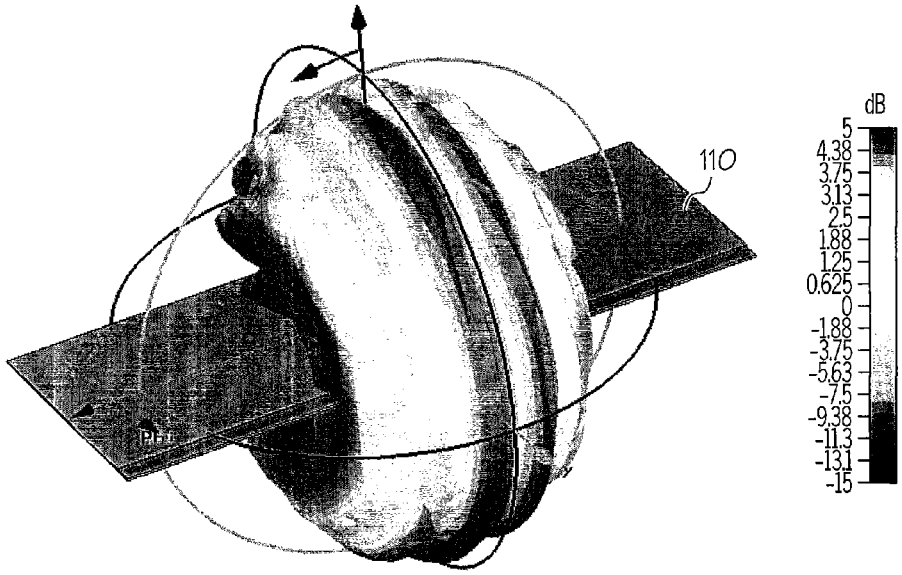
FIG. 18 illustrates surface waves, at 30 GHz excitation, along a wireless electronic device including the antenna of FIG. 16, according to various embodiments of the present inventive concepts.

Referring now to FIG. 18, the radiation pattern around a wireless electronic device 110 including an highband antenna 1600 of FIG. 16 is illustrated. When the highband antenna 1600 is excited at 30 GHz, a radiation pattern is formed around the wireless electronic device 110. The radiation pattern spans broadly and uniformly around the wireless electronic device 110.

Figure 19A:
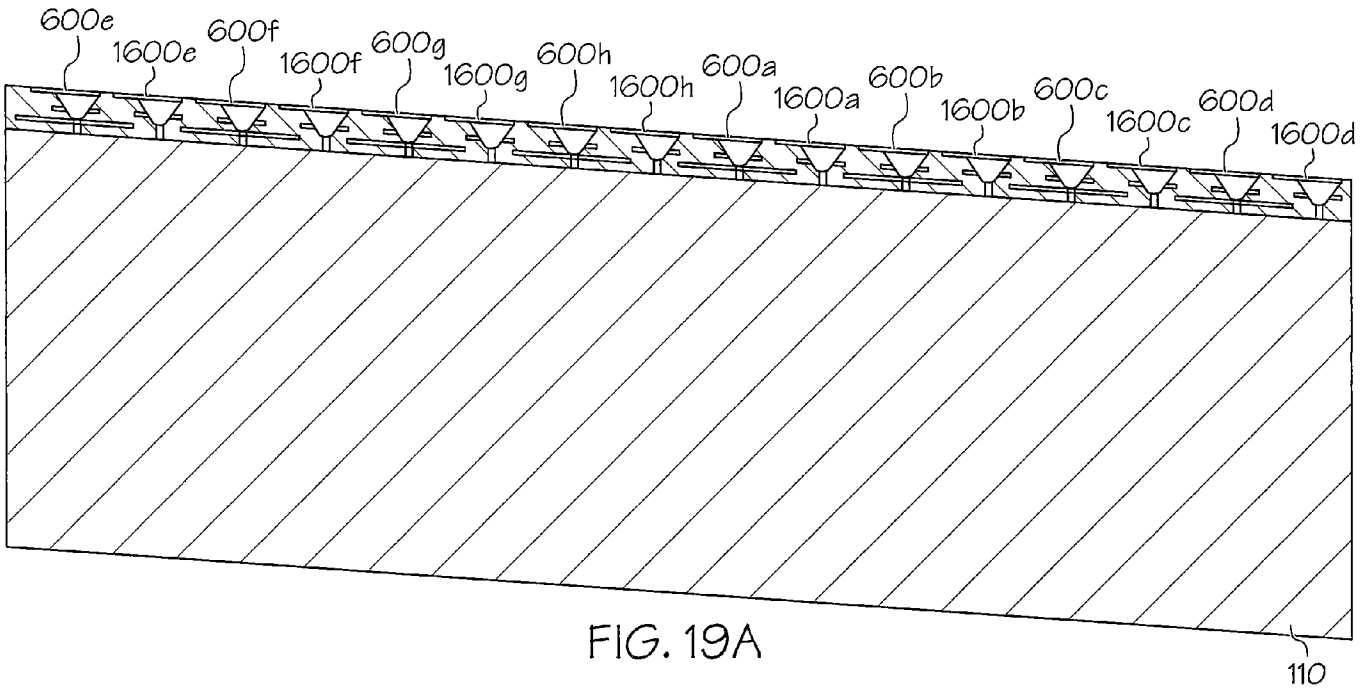
FIGS. 19A-19B illustrate a mixed dual band antenna array with additional high band wave trap antennas, according to various embodiments of the present inventive concepts.
Figure 19B:
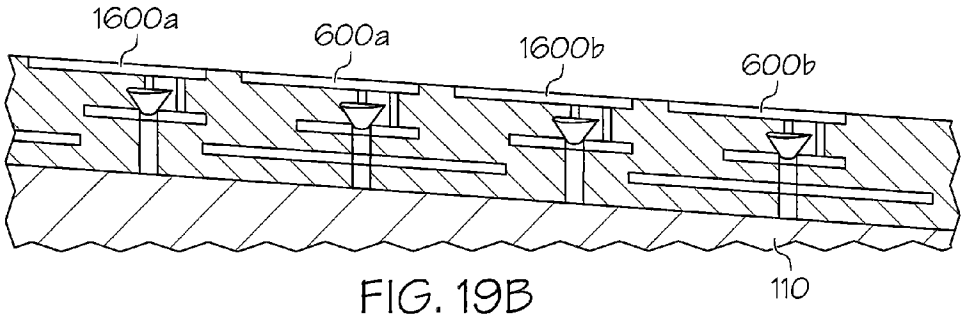

Referring now to FIG. 19A, a wireless electronic device 110 including an array of dual-band antennas 600 of FIG. 6 and an array highband antennas 1600 of FIG. 16 along the edge of the wireless electronic device 110 is illustrated. The dual-band antennas 600 may be positioned in an alternating pattern with the highband antennas 1600. For example, as illustrated in FIG. 19B, highband antenna 1600*b* may be between dual-band antennas 600*a* and 600*b*. This antenna configuration mixing dual-band antennas with highband antennas may increase the antenna gain at the highband frequency (for example, 30 GHz). Spacing between dual-band antennas 600 and highband antennas 1600 may be at 0.5 wavelengths of the highband frequency.

Figure 20:
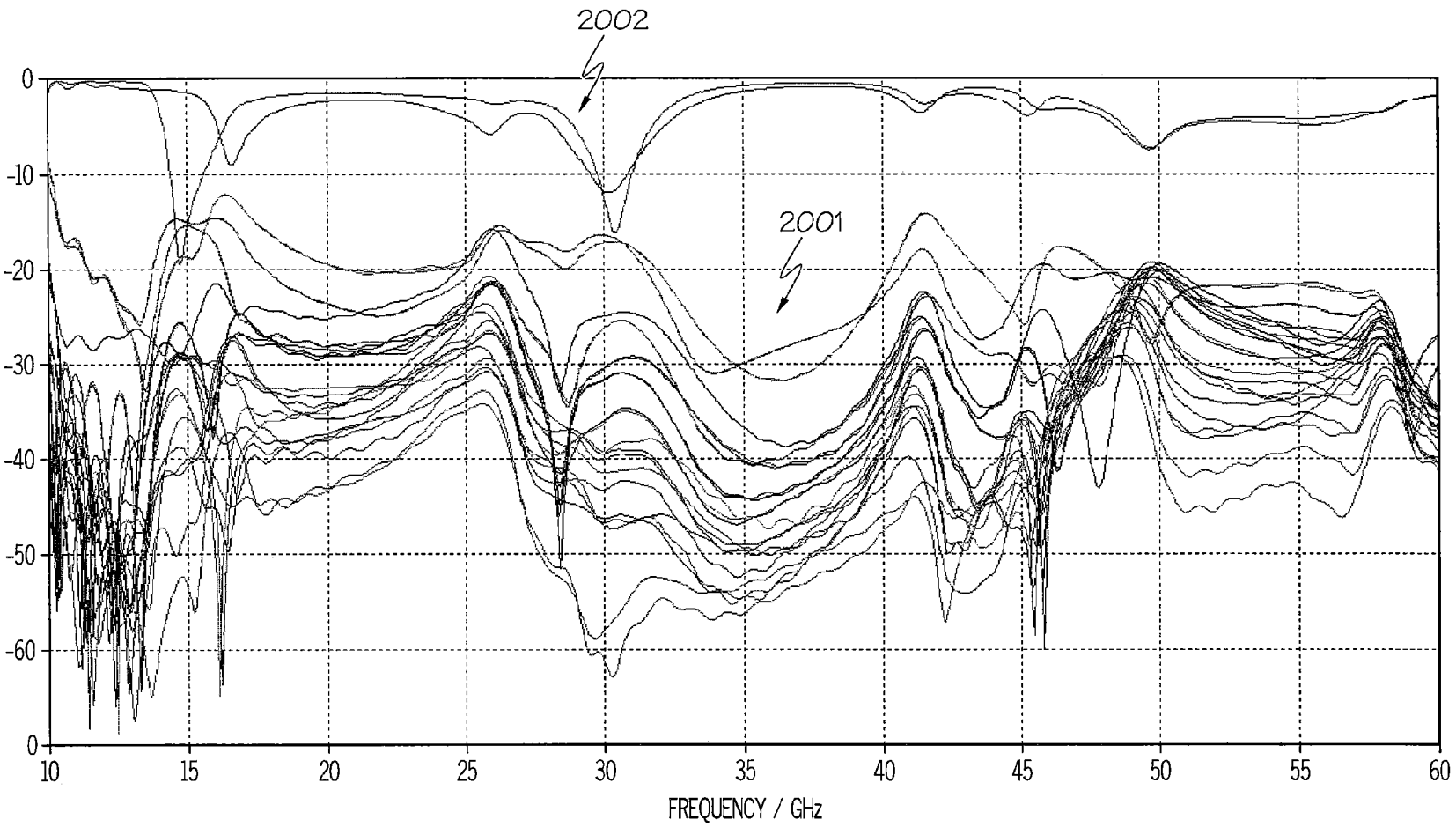
FIG. 20 graphically illustrates the frequency response of the antennas of FIG. 19A, according to various embodiments of the present inventive concepts.

Referring now to FIG. 20, the frequency response of the array of dual-band antennas 600*a*-600*h* and highband antennas 1600*a*-1600*h* of FIG. 19A is illustrated. Curve 2002 illustrates the overall frequency response of the wireless electronic device 110 including dual-band antennas 600*a*-600*h* and highband antennas 1600*a*-1600*h* of FIG. 19A. Curve 2002 illustrates resonant frequencies around 15 GHz and 30 GHz. Each of curves 2001 illustrates the frequency response for an individual antenna of dual-band antennas 600*a*-600*h* and highband antennas 1600*a*-1600*h* of FIG. 19A, with each curve including the mutual coupling between different antennas 600*a*-600*h* and 1600*a*-1600*h*. The dual-band antennas 600*a*-600*h* of FIG. 19A each include a highband wave trap 605 and/or a lowband wave trap 608, as illustrated in FIG. 6. The highband antennas 1600*a*-1600*h* of FIG. 16 each include a highband wave trap 1604, as illustrated in FIG. 16. The array of dual-band antennas 600*a*-600*h* and highband antennas 1600*a*-1600*h* provide low mutual coupling between various antenna elements, as illustrated by curves 2001 of FIG. 20.

Figure 21B:
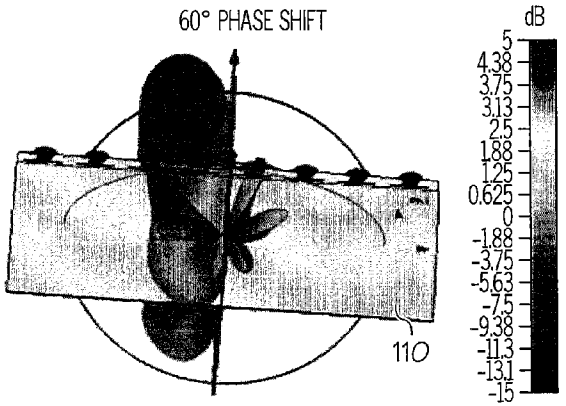
FIGS. 21A-21C illustrate the radiation patterns, at 15 GHz excitation at various phase shifts, around a wireless electronic device such as a smartphone, including the antenna array of FIG. 19A, according to various embodiments of the present inventive concepts.
Figure 21C:
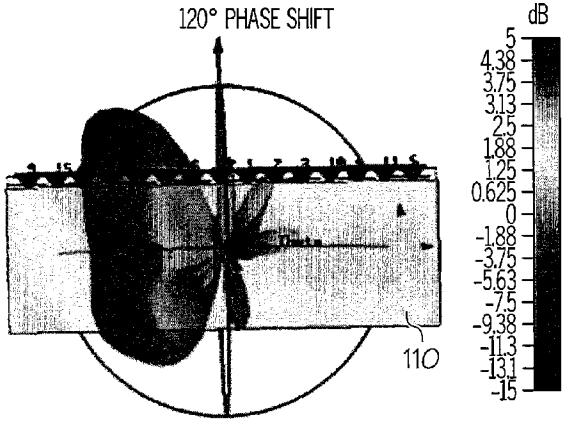
Figure 21A:
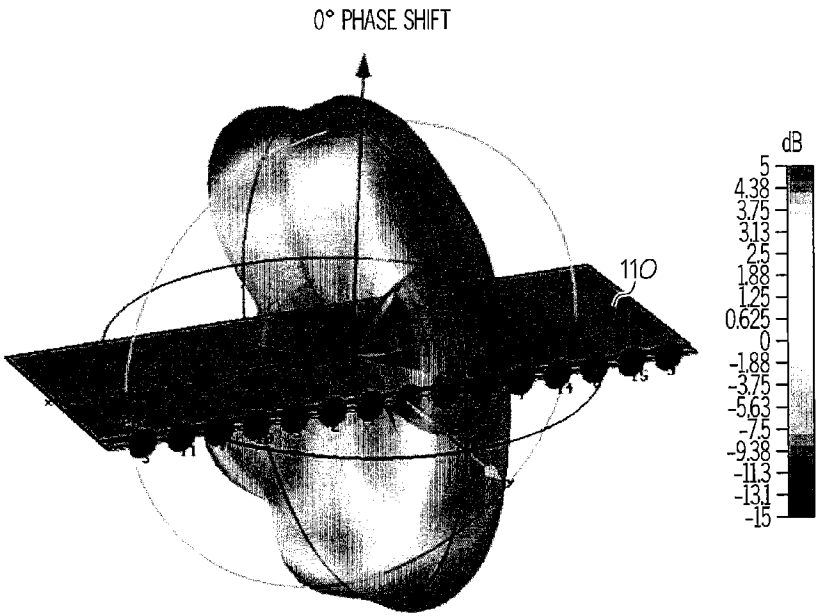

Referring now to FIGS. 21A-21C, radiation patterns at approximately 15 GHz for phase shifts of 0°, 60°, and 120°, respectively, are illustrated for the antenna array of FIG. 19A. The different phase shifts may be obtained based on processor post-processing of signals received at one or more of the antennas 600*a*-600*h* and 1600*a*-1600*h* in order to control scanning angles to provide an equiphase wave front. The radiation patterns at approximately 15 GHz at phase shifts of 0°, 60°, and 120° each span more broadly and uniformly around the wireless electronic device 110 with fewer prominent side lobes and less distortion at 15 GHz. In some cases, phase shifts may reduce performance of the antenna. However, as illustrated by FIGS. 21B and 21C, application of a phase shift at 15 GHz to antenna array 600*a*-600*h* and 1600*a*-1600*h* appears to produce excellent radiation patterns. Accordingly, the antenna array design of FIG. 19A described herein may provide suitable performance at 15 GHz for a variety of extremely high frequencies.

Figure 22B:
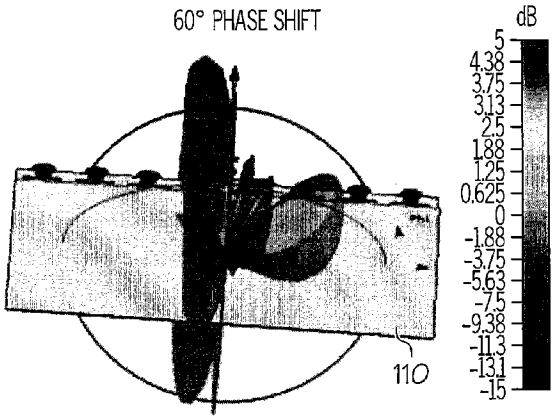
FIGS. 22A-22C illustrate the radiation patterns, at 30 GHz excitation at various phase shifts, around a wireless electronic device such as a smartphone, including the antenna array of FIG. 19A, according to various embodiments of the present inventive concepts.
Figure 22C:
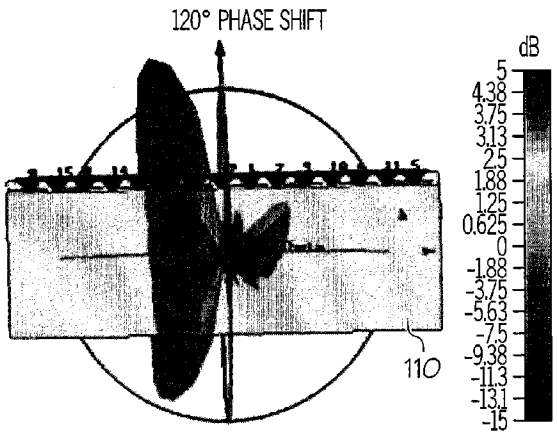
Figure 22A:
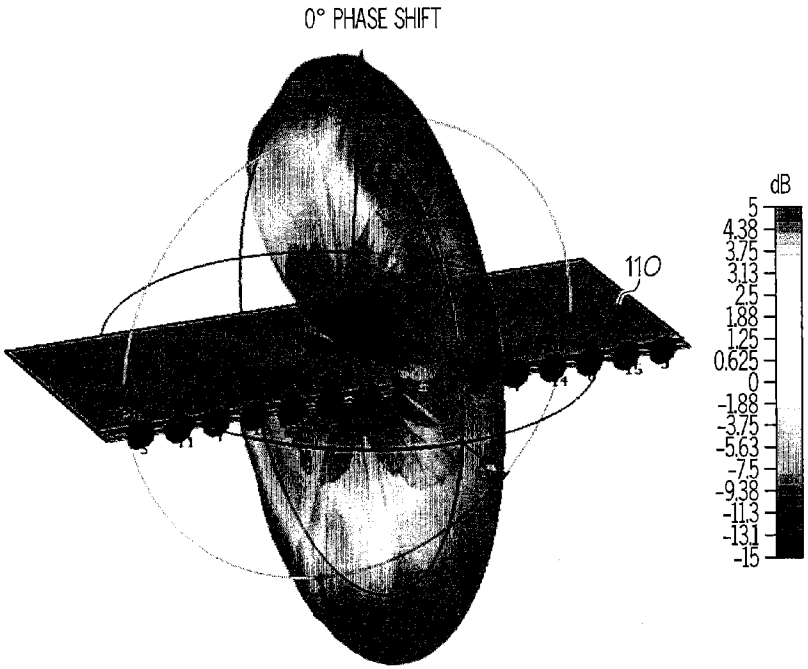

Referring now to FIGS. 22A-22C, radiation patterns at approximately 30 GHz for phase shifts of 0°, 60°, and 120°, respectively, are illustrated for the antenna array of FIG. 19A. The different phase shifts may be obtained based on processor post-processing of signals received at one or more of the antenna array 600*a*-600*h* and 1600*a*-1600*h* in order to control scanning angles to provide an equiphase wave front. The radiation patterns at approximately 30 GHz at phase shifts of 0°, 60°, and 120° each span more broadly and uniformly around the wireless electronic device 110 with fewer prominent side lobes and less distortion than the radiation pattern of FIGS. 15A-15C. Accordingly, the antenna array design of FIG. 19 described herein may provide better performance at 30 GHz for a variety of extremely high frequencies when compared to the antenna array of FIG. 12.

Figure 23:
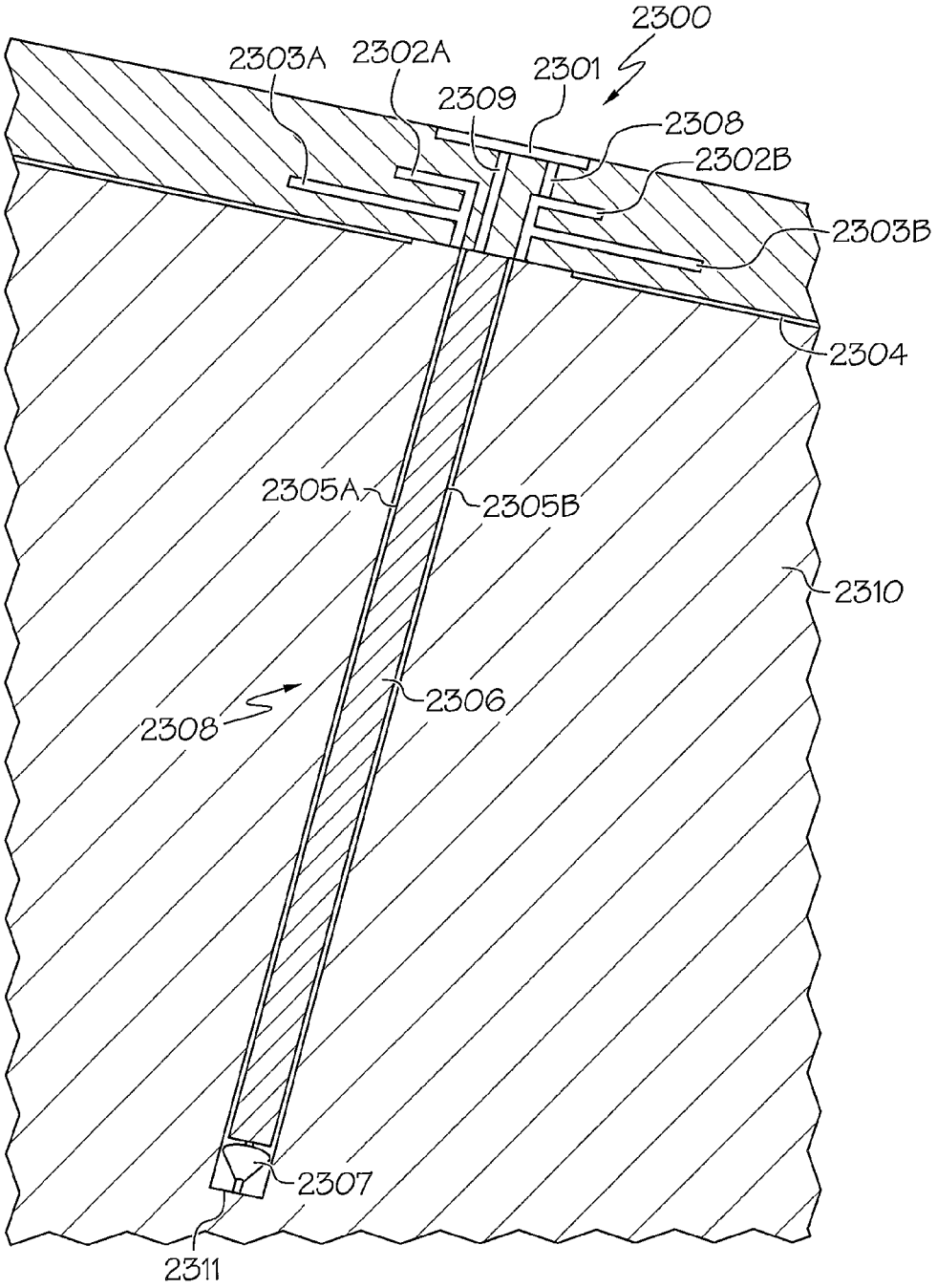
FIG. 23 illustrates an antenna including a highband wave trap and a lowband wave trap and a coplanar waveguide, according to various embodiments of the present inventive concepts.

Referring now to FIG. 23, an antenna 2300 is illustrated that includes an IFA exciting element 2301, a highband wave trap 2302 and a lowband wave trap 2303. The highband wave trap 2302 may include separate highband wave trap portions 2302A and 2302B. The lowband wave trap 2303 may include separate lowband wave trap portions 2303A and 2303B. Highband wave trap portions 2302A and 2302B and lowband wave trap portions 2303A and 2303B may be electrically connect to ground plane 2310.

Still referring to FIG. 23, an IFA feed 2309 may electrically connect the IFA exciting element 2301 to a coplanar waveguide 2308. The coplanar waveguide 2308 may include a conducting track 2306 and a pair of return conductors 2305A and 2305B that are separated from the conducting track 2306 by an air gap and/or a dielectric substrate. A test point 2307 may be connected to the coplanar waveguide 2308. In some embodiments, the return conductors 2305A and 2305B may be a portion of the ground plane 2310.

Figure 24:
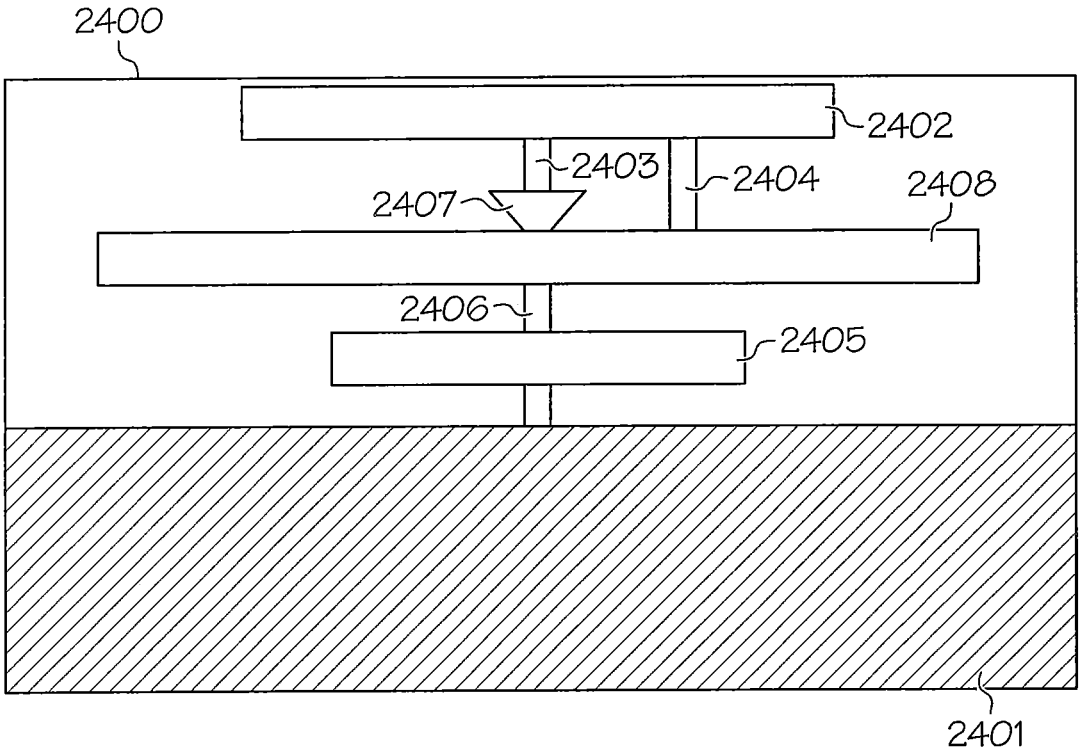
FIG. 24 illustrates an antenna including a highband wave trap and a lowband wave trap, according to various embodiments of the present inventive concepts.

According to some embodiments, the highband wave trap 605 and lowband wave trap 608 of FIG. 6 may be interchanged in location. Referring now to FIG. 24, for example, an antenna 2400 may include a highband wave trap 2405 and/or a lowband wave trap 2408. An IFA exciting element 2402 may be excited by a signal received through an IFA feed 2403. The antenna 2400 may have a highband resonant frequency and/or a lowband resonant frequency. The IFA feed 2403 may be connected at one end to a test point 2407. According to some embodiments, the test point 2407 and/or the IFA feed 2403 may be electrically connected to lowband wave trap 2408. Signals may be introduced at the test point 2407 to excite the IFA exciting element 2402. The IFA feed 2403 may be coupled to a transceiver for sending and receiving communication signals. The IFA exciting element 2402 may be electrically connected by a grounding pin 2404 to the lowband wave trap 2408. The grounding pin 2404 may be electrically conductive and may be sized to impedance match the IFA exciting element 2402. Impedance matching may be desirable for reducing mismatch losses to minimize reflections of signals, thereby reducing distortion in the radiation pattern of the antenna 2400.

The above discussed array antenna structures with highband and/or lowband wave traps may produce a dual-band antenna with uniform radiation patterns with few prominent side lobes. The highband and/or lowband wave traps may reduce surface waves, thus controlling the radiation pattern of the antenna. The antenna including the highband and/or lowband wave traps may be along an edge of the device and serve to control electromagnetic patterns along the edge. A collection of these structures with highband and/or lowband wave traps may provide beam forming functionality in addition to reduced side lobes. In some embodiments, these antenna structures may be implemented two-dimensionally on a printed circuit board and/or on a multi-dimensional printed circuit board. In some embodiments, phase shifters and/or time delay devices may be used in conjunction with array antenna elements to control scanning angles to provide an equiphase wave front. The described inventive concepts create periodic antenna dielectric structures with high quality, low loss, and wide scanning angles.

Many different embodiments have been disclosed herein, in connection with the above description and the drawings. It will be understood that it would be unduly repetitious and obfuscating to literally describe and illustrate every combination and subcombination of these embodiments. Accordingly, the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed various embodiments and, although specific terms are employed, they are used in a generic and descriptive sense only and not for purposes of limitation.

What is claimed is:

1. A wireless electronic device comprising:

an inverted-F antenna (IFA) comprising an IFA exciting element, an IFA feed, and a grounding pin, wherein the IFA exciting element is configured to resonate at both a first resonant frequency and a second resonant frequency, different from the first resonant frequency, when excited by a signal received through the IFA feed;

a highband wave trap having a length defined based on the first resonant frequency of the IFA exciting element, wherein the highband wave trap is electrically coupled to the IFA exciting element through the grounding pin;

a ground patch that is electrically coupled between the highband wave trap and a ground plane; and a lowband wave trap having a length defined based on the second resonant frequency of the IFA exciting element, wherein the lowband wave trap is electrically coupled to the ground plane through the ground patch.

2. The wireless electronic device of claim 1, wherein the length of the highband wave trap corresponds to approximately 0.5 wavelengths of the first resonant frequency of the IFA exciting element, and wherein the length of the lowband wave trap corresponds to approximately 0.5 wavelengths of the second resonant frequency of the IFA exciting element.

3. The wireless electronic device of claim 2, wherein the IFA feed is located near a center of the highband wave trap, at approximately 0.25 wavelengths of the first resonant frequency of the IFA.

4. The wireless electronic device of claim 3, wherein the grounding pin is electrically connected to the highband wave trap near a center of the highband wave trap.

5. The wireless electronic device of claim 1, wherein the ground patch is electrically connected to the highband wave trap near a center of the highband wave trap.

6. The wireless electronic device of claim 1, wherein the width of the IFA feed on a printed circuit board (PCB) layer is selected based on a thickness of the PCB layer such that the IFA is impedance matched to the IFA exciting element.

7. The wireless electronic device of claim 1, wherein the IFA is configured to induce current on the highband wave trap and/or current on the lowband wave trap such that a radiation pattern of the wireless electronic device forms a dipole antenna pattern.

8. The wireless electronic device of claim 1, wherein the length of the ground patch determines a bandwidth of the highband wave trap and/or the lowband wave trap.

9. The wireless electronic device of claim 1, wherein the grounding pin is electrically conductive and is impedance matched to the IFA exciting element.

10. The wireless electronic device of claim 1, wherein the IFA feed comprises a coplanar waveguide that is electrically connected to the ground plane, wherein the coplanar waveguide comprises a conductor track, a first return track on a first side of the conductor track, and a second return track on a second side of the conductor track, opposite the first return track, and wherein the first and second return tracks are electrically isolated from the conductor track.

11. The wireless electronic device of claim 1, wherein the IFA comprises a first IFA, the wireless electronic device further comprising:

one or more additional IFAs each comprising:

an additional IFA feed;

an additional IFA exciting element that is configured to resonate at both the first resonant frequency and the second resonant frequency when excited by the signal received through the additional IFA feed;

an additional grounding pin;

an additional ground patch;

an additional highband wave trap that is electrically coupled to the additional IFA exciting element through the additional grounding pin; and an additional lowband wave trap that is electrically coupled to the ground plane through the additional ground patch, wherein the first IFA and the one or more additional IFAs extend along an edge of the wireless electronic device.

12. The wireless electronic device of claim 11, wherein a spacing between adjacent ones of the highband wave traps is between 0.25 wavelengths and 0.5 wavelengths of the first resonant frequency.

13. The wireless, electronic device of claim 11, wherein a spacing between adjacent ones of the lowband wave traps is between 0.25 wavelengths and 0.5 wavelengths of the second resonant frequency.

14. The wireless electronic device of claim 11, wherein the one or more additional IFAs comprise three additional IFAs, and wherein the first IFA and the three additional IFA are configured to receive and/or transmit multiple-input and multiple-output (MIMO) communication.

15. The wireless electronic device of claim 1, further comprising:

one or more highband IFAs, each comprising:

a highband IFA feed;

a highband IFA exciting element that is configured to resonate at either the first resonant frequency or the second resonant frequency when excited by the signal received through the highband IFA feed;

a highband grounding pin;

a highband ground patch; and a dedicated highband wave trap that is electrically coupled to the highband IFA exciting element through the highband grounding pin and that is electrically coupled to the ground plane through the highband ground patch;

wherein the one or more highband IFAs extend along an edge of the wireless electronic device.

16. The wireless electronic device of claim 15, wherein the first IFA and one of the additional IFAs are positioned in an alternating pattern with at least one of the highband IFAs along the edge of the wireless electronic device.

17. A wireless electronic device comprising:

a plurality of dual-band inverted-F antennas (IFAs), each comprising an IFA feed, an IFA exciting element that is configured to resonate at both a first resonant frequency and a second resonant frequency when excited by a signal received through the IFA feed, a grounding pin, and a ground patch;

a plurality of highband wave traps that are each electrically coupled to a respective one of the plurality of dual-band IFAs through a respective grounding pin and that are each electrically coupled to a ground plane through a respective ground patch;

a plurality of lowband wave traps that are each electrically coupled to a respective one of the plurality of dual-band IFAs through the respective ground patch, wherein a length of one of the plurality of highband wave traps is based on the first resonant frequency of the respective IFA exciting element, wherein a length of one of the plurality of lowband wave traps is based on the second resonant frequency of the respective IFA exciting element, and wherein the plurality of dual-band IFAs extend along an edge of the wireless electronic device.

18. The wireless electronic device of claim 17, the wireless electronic device further comprising:

a plurality of highband IFAs, each comprising:

a highband IFA feed;

a highband IFA exciting element that is configured to resonate at either the first resonant frequency or the second resonant frequency when excited by the signal received through the highband IFA feed;

a highband grounding pin;

a highband ground patch; and a dedicated highband wave trap that is electrically coupled to the highband IFA exciting element through the highband grounding pin and that is electrically coupled to the ground plane through the highband ground patch, wherein the one or more highband IFAs extend along an edge of the wireless electronic device.

19. The wireless electronic device of claim 18, wherein ones of the plurality of dual-band IFAs are positioned in an alternating pattern with ones of the plurality of the highband IFAs along the edge of the wireless electronic device such that a given highband IFA is between adjacent ones of the plurality of dual-band IFAs.

* * * * *